US005613390A

United States Patent [19]

Ishikawa et al.

[11] Patent Number: 5,613,390

[45] Date of Patent: Mar. 25, 1997

[54] CORNER REDUCTION DEVICE EQUIPPED WITH CORNER ROLLS, CONTROL DEVICE THEREOF, AND METHOD OF ROLLING BY USING THESE DEVICES

[75] Inventors: Takashi Ishikawa; Takao Yunde; Toshisada Takechi, all of Chiba; Katsumi Okada, Fujisawa; Takatoshi Amakawa, Yokohama, all of Japan

[73] Assignee: Kawasaki Steel Corporation, Hyogo, Japan

[21] Appl. No.: 344,677

[22] Filed: Nov. 21, 1994

[30] Foreign Application Priority Data

Nov. 24, 1993 [JP] Japan ..... 5-293569
Mar. 17, 1994 [JP] Japan ..... 6-071261

[51] Int. Cl.[6] ..... B21B 1/30

[52] U.S. Cl. ..... 72/13.7; 72/199; 72/224; 72/366.2

[58] Field of Search ..... 72/13.4, 13.7, 72/199, 224, 225, 365.2, 366.2, 229

[56] References Cited

U.S. PATENT DOCUMENTS 5,024,074 6/1991 Blunier et al. ..... 72/199
5,218,848 6/1993 Takakura et al. ..... 72/199

FOREIGN PATENT DOCUMENTS 1024042 4/1955 Germany .
3903984 8/1990 Germany .
49-91944 9/1974 Japan .
53-28542 3/1978 Japan .
55-128309 10/1980 Japan .
57-168705 10/1982 Japan .
57-168709 10/1982 Japan .
60-158910 8/1985 Japan .
61-165209 7/1986 Japan .
63-60003 3/1988 Japan .
2-25202 1/1990 Japan .
4-138805 5/1992 Japan .
92/19394 11/1992 WIPO .

OTHER PUBLICATIONS

Patent Abstracts of Japan, vol. 16, No. 410 (M–1302), 28 Aug. 1992.
Patent Abstracts of Japan, vol. 10, No. 372 (M–544), 11 Dec. 1986.
Patent Abstracts of Japan, vol. 4, No. 179 (M–46), 11 Dec. 1980.
Patent Abstracts of Japan, vol. 7, No. 9 (M–185), 14 Jan. 1983.
Patent Abstracts of Japan, vol. 9, No. 326 (M–441), 21 Dec. 1985.

*Primary Examiner*—Daniel C. Crane
*Assistant Examiner*—Thomas C. Schoeffler
*Attorney, Agent, or Firm*—Oliff & Berridge

[57] ABSTRACT

In a corner reduction device for reducing side corners of a slab with corner rolls, a pair of upper and lower corner rolls are mounted inside a unitary unit frame, and a corner roll unit housing the unitary frame which is movable in the direction of width and vertical direction of the material is formed. Vertical position of the corner roll unit is controlled by a lifting power control cylinder through a push rod and position in direction of material width is controlled by a reduction cylinder. Driving of cylinder servo valves is controlled in accordance with position set values set by position setters, load set values set by load setters, and feedback signals from position sensors, thereby controlling the corner roll positions to fixed lateral and vertical positions. The driving of the servo valves is corrected according to values detected by cylinder pressure sensors, to evenly reduce the right and left corners of the material.

16 Claims, 21 Drawing Sheets

FIG. 25

| | SERVO VALVE 445a | | SERVO VALVE 445b | | SWITCHING VALVE 458 | | SWITCHING VALVE 459 | |
|---|---|---|---|---|---|---|---|---|
| SDL PORT | a | b | a | b | a | b | a | b |
| POLL/CLOSE<br>REDUCTION CYLINDER 122 | ○ | × | | | | | | |
| POLL/OPEN<br>REDUCTION CYLINDER 122 | × | ○ | | | | | | |
| POLL/UP<br>LIFTING POWER CONTROL CYLINDER 144 | | | ○ | × | | | | |
| POLL/DOWN<br>LIFTING POWER CONTROL CYLINDER 144 | | | × | ○ | | | | |
| DOOR/OPEN/HIGH SPEED<br>HYDRAURIC MOTOR 238 | | | | | ○ | × | ○ | × |
| DOOR/OPEN/LOW SPEED<br>HYDRAURIC MOTOR 238 | | | | | × | × | ○ | × |
| DOOR/OPEN/HIGH SPEED<br>HYDRAURIC MOTOR 238 | | | | | × | ○ | × | ○ |
| DOOR/OPEN/LOW SPEED<br>HYDRAURIC MOTOR 238 | | | | | × | × | × | ○ |

CORNER REDUCTION DEVICE EQUIPPED WITH CORNER ROLLS, CONTROL DEVICE THEREOF, AND METHOD OF ROLLING BY USING THESE DEVICES

BACKGROUND OF THE INVENTION

1. Field of the Invention

The present invention relates to a corner reduction device for rolling equipment for reducing side corners of a material by the use of corner rolls, a control device thereof, and a method of rolling the material by the use of these devices.

2. Description of the Related Art

Generally there is a necessity of performing a roughing process prior to a finish rolling process in order to produce rolled plates such as hot-rolled slabs by rolling to specific width and thickness.

In conventional equipment for performing the aforesaid roughing process, as schematically shown as one example in FIG. 1, rolling equipment 3 comprising an edging mill (edger) 1 and a horizontal mill (mill) 2 is arranged in multiple stages along a pass line L, and a carrying table 5 having a multitude of carrying rolls (table rolls) 4 arranged in both the front and rear positions of each of the rolling equipment 3. Furthermore, side guides 6 so formed as to avoid interference of each carrying roll 4 are arranged on the right and left sides of the pass line L, facing each other, above the carrying table 5. On the back surface of each carrying table 5, a cylinder 7 as a space controlling device is provided. A material 8 such as a slab to be conveyed on the carrying table 5 is guided to the rolling equipment 3 while its position is being restricted by the right and left side guides 6, then being repetitively rolled for reduction to specific width and thickness by the edging mills 1 and the horizontal mills 2. A reference numeral 9 denotes right and left table frames constituting the carrying table 5, and a reference numeral 10 expresses a bearing of the carrying roll 4.

In this roughing process, generally, a material is passed through the horizontal mill and the edging mill a plurality of times to produce a sheet bar. It is known that a slab 8 (a material to be rolled) shown in the top view of FIG. 2A, when horizontally rolled in the reverse pass of the roughing process as shown in the middle view of FIG. 2A, spreads in the direction of width, causing the side faces of the material to be subjected to bulging. Subsequently, with the edging of the side faces 8E of the slab 8 as shown in the bottom view of FIG. 2A, the corners 8C of the side faces of the material curve around towards the material surface. Consequently, the corners 8C are not fully reduced by the rolls as compared with other portions of the material, resulting in insufficient smoothing of wrinkled or cracked portions. The corners 8C of the side faces of the material curve around towards the material surface, producing a defect in the side edges of products. In the event of such a surface defect, the side edges of the material must be cut off, thereby resulting in a worsened yield.

Also, in rolling a relatively narrow and thick material, for example a slab for thick plate, by the above-described rolling equipment, with the repetition of rolling the slab 8 down to a sheet like a sheet bar in both directions of width and thickness by the edging mill 1 and the horizontal mill 2, there occurs an edge overlap 8L at edges on both sides of the slab 8 as shown in FIG. 3. More specifically, as shown in FIG. 2B, edging in the normal pass causes spreads in the upper and lower surface of the slab 8, which causes the overlap 8L in the subsequent horizontal rolling. The edge overlap 8L portion must be cut off in a later process, which will consequently become a cause to lower the yield of steel products.

In the meantime, a method for improving the quality of side face corner portions 8C of the slab 8 by carrying out the reduction of the side face corner portions 8C of the slab (material) 8 by the use of a caliber roll 11 as shown in FIG. 4A and FIG. 4B has been disclosed in Japanese Patent Laid-Open No. Sho 53-28542. Also disclosed in Japanese Patent Laid-Open No. Hei 2-25202 is a method, as shown in FIG. 5, for removing the side face corner portions of the slab 8 by using a grinding or turning device 12 annexed to the rolling mill 3. Furthermore in Japanese Patent Laid-Open No. Sho 63-161803 is proposed a method for rolling the corner portions by means of the caliber rolls 11 as shown in FIG. 4 and corner rolls 12 each having an inclined shaft center as shown in FIG. 6. In FIG. 6, a reference numeral 13 denotes a hydraulic cylinder for pressing with the corner rolls.

However, the prior art technique disclosed in Japanese Patent Laid-Open No. Sho 53-28542 has the following disadvantages:

(a) Abrasion will occur because of different peripheral speeds of the caliber roll 11 between the end positions 8D and 8E of the corner portion 8C shown in FIG. 4A.

(b) No substantial effect will be obtainable in case of a different thickness of the slab 8.

Further, the prior art technique disclosed in Japanese Patent Laid-Open No. Hei 2-25202 has the following disadvantages:

(c) Deteriorated yield will result with the removal of a defect area.

(d) It is hard to follow up a change in material width.

Also the prior art technique disclosed in Japanese Patent Laid-Open No. Sho 63-16803 has the following disadvantages:

(e) Abrasion will occur in the caliber roll 11 due to a difference in the peripheral speeds of the caliber roll.

(f) The corner roll 12 rolls linearly, resulting in a large rolling stroke and a very large equipment.

(g) The corner roll 12 is required to operate correspondingly to changes in material width, and therefore a width controlling device will be needed separately from a rolling mechanism, requiring a larger cost of equipment.

The use of corner rolls for rolling slab corners has been disclosed also in Japanese Patent Laid-Open Nos. Sho 49-91944 and Sho 63-60003, but has the same disadvantage as the corner rolls in Japanese Patent Laid-Open No. Sho 63-16803.

Furthermore, the slab 8 to be rolled at corners is not necessarily conveyed in a horizontal state along the pass line L; and therefore it is possible that there will occur waviness at the side edges or a warp in a cross direction (C warp), or a warp in the longitudinal direction (camber). Particularly, in the case of broadside rolling of a thin slab, uneven rolling reduction of the upper and lower corners and an increased C warp were likely to occur.

SUMMARY OF THE INVENTION

It is a first object of the present invention to provide a corner reduction device which is capable of obviating the above-described disadvantages and carrying out corner rolling reduction reliably throughout the overall length of the material at a low cost of equipment.

It is a second object of the present invention to provide a method and device for controlling the corner reduction device which enable restricting the uneven upper and lower corner rolling reduction and an increased C warp of the material while making the most of the advantages of the corner reduction device.

It is a third object of the present invention to provide a method for rolling reduction of material corners by utilizing the corner reduction device described above.

The present invention comprises the following technological means for the purpose of accomplishing the first object to get rid of the disadvantages of the prior art corner reduction device.

That is, the corner reduction device according to the present invention for rolling the side corners of a material by corner rolls is equipped with a pair of upper and lower corner rolls which are secured on a unitary frame, thus forming a corner roll unit which is movable in both lateral and vertical directions of materials to be rolled, and a mechanism for controlling the lateral and vertical positions of the corner roll unit.

The corner roll may be either a non-drive idle roll or a drive roll.

The corner reduction device may be mounted on the side guide at the entrance and/or exit side of the rolling mill.

The corner roll unit may be designed to be withdrawable to the outside of the rolling line from the position of operation and a guide beam closing member may be provided to close an opening after the withdrawal of the corner roll unit, so that when corner rolling reduction is not performed, the corner reduction device can be withdrawn and the slab-side surface of the guide beam can be closed, and that a guide beam of an existing reduction device can be used, giving satisfactory results through simple improvements.

The unitary frame mounted with the upper and lower corner rolls of the corner reduction device may be releasably inserted within the casing, and can be replaced together with the corner rolls by drawing out upwardly.

The present invention, therefore, facilitates the mounting of the corner reduction device to obtain steel sheets of good quality even at the edge portions without deteriorating the prior art side guide function. Besides, corner roll replacement in the rolling line can be carried out extremely easily.

The corner reduction device of the present invention of the above-described constitution has the following advantages:

(1) Since a pair of the upper and the lower corner rolls are secured on a unitary frame, the equipment can be largely reduced in size. The unitary frame is movable in both the lateral and vertical directions of the material being rolled. The height of the pair of corner rolls and the distance in the direction of width of the material are adjustable in accordance with the width and thickness of the material, thereby enabling the optimum corner rolling reduction of the material.

(2) With the above-decreased reduction in size of the equipment, the roller reduction device can be mounted on the side guide of an existing hot-rolling device, thereby dispensing with a width controlling device for exclusive use for the corner reduction device.

(3) When corner rolling reduction is not needed, the unitary corner roll unit can be retreated sidewards.

In the meantime, a new problem will be found by mounting the corner reduction device on the side guide in the vicinity of a rolling mill as described above, and must be solved. Hereinafter the solution of the problem will be explained. The side guide on the entrance or exit side of the rolling mill can effectively perform centering and restriction of bends of the material, and therefore it is desirable to adjust the width of the guide bar to a position as close to the material as possible, and also to guide as close to a material bite position of the rolling mill as possible.

In this case, however, if the corner reduction device is mounted on the side guide, both guiding and corner rolling reduction must be done at the same time. Therefore, when the corner roll unit is in the retreat position in the corner reduction device, there is formed an opening in that area of the side guide. This opening will give an extremely adverse effect to the centering and bend restriction of the material when the corner roll unit is in the retreat position, that is, when no corner rolling reduction is carried out. In a reversing mill, the material is likely to be caught by this opening. This problem is very serious because not all of the materials require corner rolling reduction and the corner reduction device on the protruding side must be withdrawn when the corner reduction device is mounted on the side guide of the reversing mill. Also, when the corner reduction device is installed on the forward end of the guide bar so that there will not be formed an opening at the guide bar, there will be presented such a problem that the side guide will fail to guide close to the material bite position of the rolling mill.

The present invention has solved this problem by an extremely simple means. That is, in an equipment mounted with the corner rolling device on the side guide on the entrance or exit side of the roughing mill, when the corner rolling reduction is not carried out, the corner roll unit. retreats sidewards from the rolling line; and there is provided a guide beam closing member for closing the opening section of the side guide beam likely to occur at this time, thus realizing a simplified corner reduction device which will not deteriorate the function of the side guide even when the corner roll unit has been withdrawn.

Furthermore, there exists such a problem that since the corner rolls of the corner reduction device are secured in an inclined position, the upper and lower corner rolls are very hard to remove for replacement and moreover require a long time for replacement. This problem is due to the inclined mounting and unitization of the rolls, and this is a peculiar problem largely different from that, in ordinary horizontal and vertical rolling mills, wherein rolls including chocks are easily replaceable.

To solve the problems stated above, the corner rolls are made to be replaced by whole corner roll frame, thereby enabling large reduction of the length of time required for replacement. In this case, replacement of the rolls alone may be performed after disassembling the corner roll frame off the line. When roll replacement is performed off the line, the attitude of the corner roll mounting frame can be changed so as to facilitate handling of the corner rolls during the off-line replacement of the rolls; that is, replacement work efficiency has been largely improved as compared with on-line replacement. For example, the replacement work can easily be effected simply by tilting the corner roll mounting frame until the corner rolls are at the horizontal level off the line.

In order to accomplish the second object, the present invention provides a method of controlling the corner reduction device and a control device which comprise a casing which can be moved by a reduction cylinder in the direction of the material width and is installed opposite to a side guide located on either position in the direction of the material width across the pass line, a frame which has upper and lower corner rolls mounted in an L-shaped arrangement and is vertically movably installed inside the casing, a balance cylinder which is provided on the underside of the frame for the purpose of giving a lifting power to raise the frame, and a lifting power control cylinder for controlling the lifting power disposed on the upper surface side of the frame, so that the drive of a reduction cylinder servo valve for operating the reduction cylinder will be adjusted according to position and load set values based on a preset material width on the entrance side when the upper and lower corner roll positions are controlled and the reduction cylinder position will be fed back to control the upper and lower corner rolls so as to obtain constant reduction in the direction of material width, and furthermore that the reduction cylinder pressure will be detected to determine a difference between the pressure and the preset value of load, in order that the driving of the reduction cylinder servo valve will be corrected in accordance with this difference.

Also, the present invention provides a method of controlling the corner reduction device and a control device which comprise a casing which can be moved by a reduction cylinder in the direction of the material width and installed opposite to a side guide located on either position in the direction of the material width across the pass line, a frame which has upper and lower corner rolls mounted in an L-shaped arrangement and is vertically movably installed inside the casing, the balance cylinder which is provided on the underside of the frame for the purpose of giving a lifting power to raise the frame, and a lifting power control cylinder for controlling the lifting power disposed on the upper surface side of the frame, so that the drive of a lifting power control cylinder servo valve for operating the lifting power control cylinder will be adjusted according to position and load setting values based on a preset pass level and the lifting power control cylinder position will be fed back to control the upper and lower corner rolls so as to obtain constant reduction, and furthermore when a displacement in vertical direction such as the C-warp occurs, the lifting power control cylinder pressure will be detected to determine a difference between the pressure and the preset value of load, in order that the driving of the lifting power control cylinder servo valve will be corrected in accordance with this difference.

If there has occurred a displacement in the direction of width, such as the camber, in the material being rolled at corners thereof, a value detected by a pressure sensor for the reduction cylinder is calculated with a set value of load by means of a calculator for load correction, whereby a drive command for driving the reduction cylinder servo valve will be corrected, thus controlling the position of the reduction cylinder to correct corner roll positions in the direction of material width to proper positions.

Since the drive of the reduction cylinder servo valve can be adjusted on the basis of the set value of position corresponding to the material width on the entrance side, the set value of load, and the feedback value of position to thereby control the upper and lower corner rolling roll positions so as to obtain constant reduction in the direction of width through the operation of the reduction cylinder, and also can be corrected, as described above, through comparative calculation of the value detected by the reduction cylinder pressure sensor and the set value of load, it is possible to move the corner rolling roll laterally in accordance with the camber of the material, thus enabling the right and left corner rolling reduction of materials to be uniform.

In the meantime, if there has occurred a vertical displacement such as waviness in a material, the value detected by the lifting power control cylinder pressure sensor is calculated with the set value of load by means of the calculator for load correction and a drive command for driving the lifting power control cylinder servo valve is corrected, thereby enabling the control of the lifting power control cylinder position and accordingly the correction of the vertical position of the corner rolls to a proper position.

As described above, the drive of the lifting power control cylinder servo valve is adjusted on the basis of the set value of position corresponding to the pass level, the set value of load, and the feedback value of position, to thereby control the upper and lower corner rolls so as to obtain constant reduction through the operation of the lifting power control cylinder, and also the value detected by the lifting power control cylinder pressure sensor and the set value of load are comparatively calculated to enable the correction of drive of the lifting power control cylinder servo valve. It is, therefore, possible to move the corner rolls up and down along waves present at the side edges of the material and consequently to make the vertical corner rolling reduction of the material uniform.

A method of using the corner reduction device for accomplishing the third object of the present invention is as follows.

After the material is gripped by the reversing mill, corner rolling reduction starts by the use of the corner roll unit of the corner reduction device mounted on the side guide on the entrance side. Then, the rolling of the material is effected until the tail end of the material by continuing rolling. When the reverse rolling of the material is effected from the exit side, opening of the side guide on the entrance side is closed and corner rolling reduction is started by the use of the corner roll unit of the corner reduction device mounted on the side guide on the exit side after the material has been bit in the reversing mill, thus performing corner reduction of the front area of the material.

With the devices of the present invention mounted on both the entrance and exit sides of the reversing mill as described above, a material, after being gripped in the reversing mill, is rolled to the tail end by means of the corner reduction device on the entrance side and then reversed. At this time, after the material is gripped in the reversing mill, corners of the front area of the material are rolled by the corner reduction device on the exit side. According to this method, the rolling reduction of the material can be performed properly for the overall length of the material by use of drive force of the reversing mill without producing any defect in the side edges of products even if the corner rolls are non-drive idle rolls.

Furthermore, by making corner rolls as drive rolls or using pinch rolls to feed a material, the corner roll unit of the aforesaid corner reduction device mounted on the side guide on the entrance side starts rolling reduction, thus reducing the material from the leading end to the tail end, in not only reverse rolling but also in one-way rolling.

These and other objects, features and advantages of the present invention will become more apparent upon a reading of the following description and appended drawings.

BRIEF DESCRIPTION OF THE DRAWINGS

The preferred embodiments will be described with reference to the drawings, wherein like elements have been denoted throughout the figure with like reference numerals, and wherein:

FIG. 25 is a view showing the state of operation of an actuator of the present embodiment.

DESCRIPTION OF THE PREFERRED EMBODIMENTS

Figure 1:
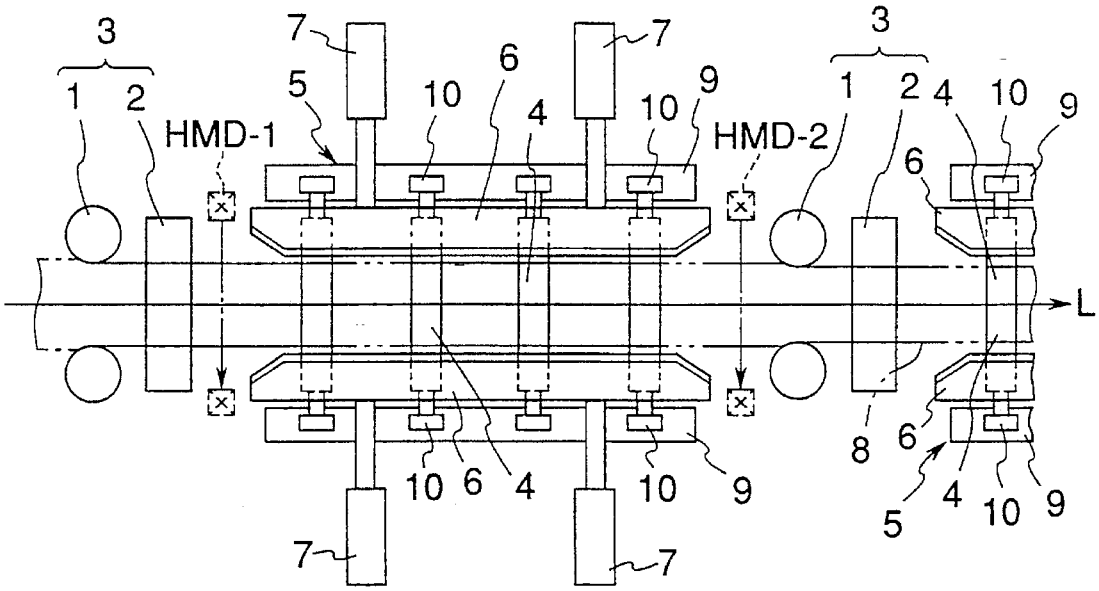
FIG. 1 PRIOR ART
FIG. 1 is a schematic view showing one example of a prior art rolling equipment.

The preferred embodiments of the present invention will now be described with reference to the accompanying drawings.

The first embodiment of the present invention will be explained in detail with reference to FIG. 7. An upper corner roll 112 and a lower corner roll 114 are pivotally secured on a unitary frame 116 of a corner roll unit 110. The corner roll unit 110 is of a unitary construction, and is mounted in such a manner that it is movable in the horizontal direction (in the direction of width of a material 8) and vertical direction in relation to a side guide 306. A reduction cylinder 122 mounted on a side guide 306 functions to move the corner roll unit 110 horizontally back and forth through a rod 124 and a universal joint 126. The corner roll unit 110 is vertically movable, and is vertically positioned by means of a balance cylinder 130 and a lifting power control cylinder 144.

Figure 8:
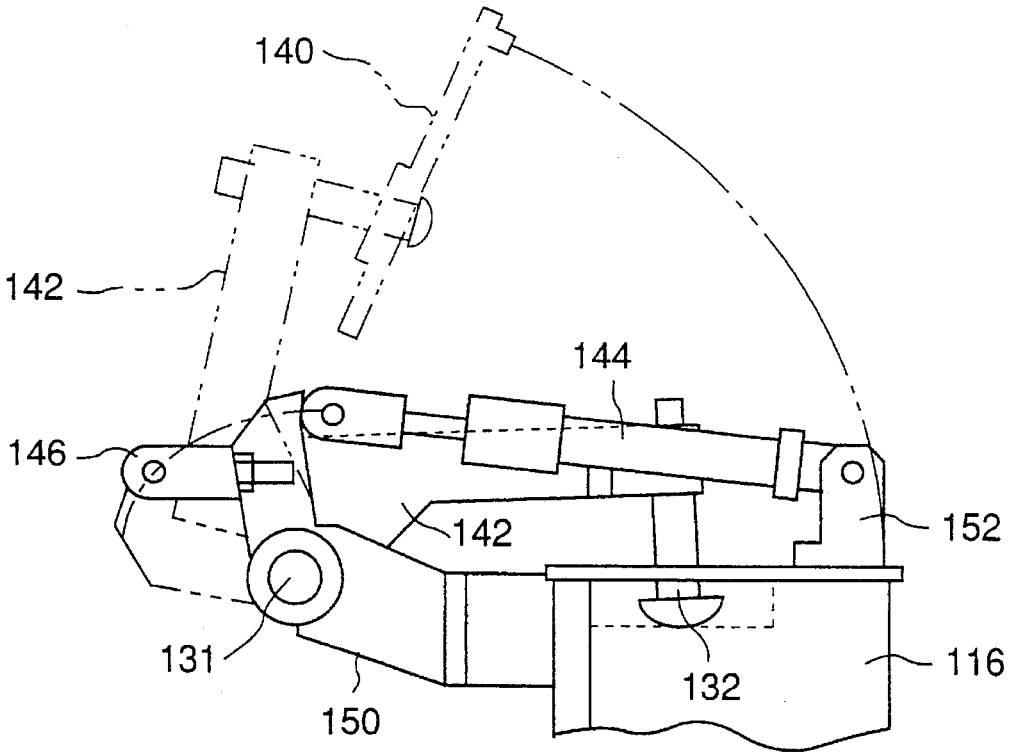
FIG. 8 is a side view of a vertical positioning device of the first embodiment.
Figure 9:
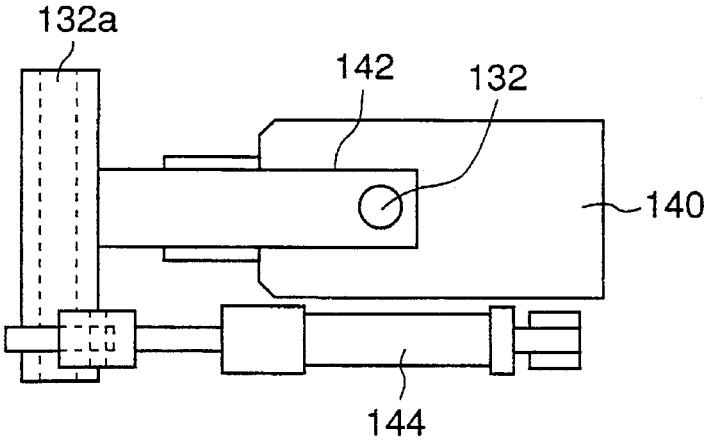
FIG. 9 is an elevation view of the vertical positioning device of the first embodiment.

Examples of the vertically movable mechanism are shown in FIGS. 8 and 9. When the lifting power control cylinder 144 interposed between a link lever 150 mounted on one end of a shaft 131 and an arm 152 is contracted, a push rod 132 moves downwardly through the shaft 131 and an arm 142, pushing the unitary frame 116 downward to thereby determine the vertical position of the unitary frame 116 in association with the balance cylinder 130. On the back side of the unitary frame 116 is disposed a linear bearing 117; the unitary frame 116 vertically·slides on the linear bearing 117 in relation to the casing 118 secured vertically. The casing 118 having a side wall support roller 128 moves horizontally.

Figure 7:
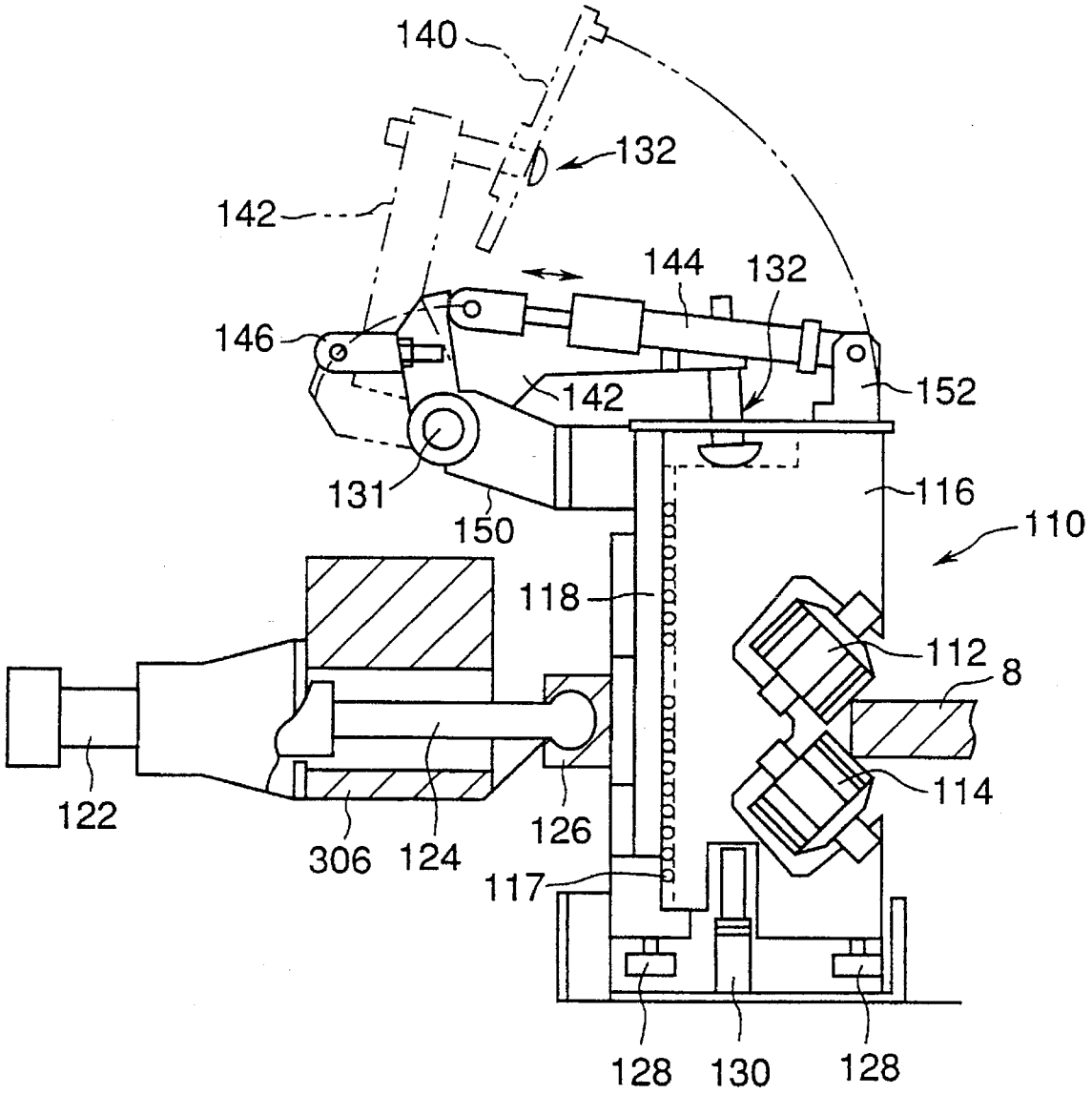
FIG. 7 is a side view of the first embodiment of a corner reduction device according to the present invention.

The universal Joint 126 shown in FIG. 7 is provided so as to allow horizontal and vertical movement of the unitary frame 116. The corner roll unit 110, therefore, can reduce corner portions of the sides of the slab 8 in an arbitrary position in accordance with the width and thickness of the slab 8 to be reduced at corners thereof.

The purpose of using of the balance cylinder 130 is to cope with the weight of the corner roll unit 110 so as to preload within a controllable range of the lifting power control cylinder 144, and to increase the speed of response of vertical position control by the lifting power control cylinder 144 so that the corner rolls can follow the waviness (up-and-down motion) of the slab 8 moving at a high speed. Where the delay of speed of response of the vertical position control does not present any problem, an elastic body such as a spring can be used instead of the balance cylinder 130.

The corner roll unit 110 comprising the unitary frame 116 and the upper and lower corner rolls 112 and 114 is housed within the casing 118. The casing 118 has an upper cover 140, which is designed to be withdrawn sidewards from above the unitary frame 116, together with the push rod 132, by a circular lifting motion of the arm 142. The cover 140 and the push rod 132 are operated by a rod 146 of the lifting power control cylinder 144. With this cover 140 held in the retreat position, the unitary frame 116 can be pulled out upwardly from the casing 118. Therefore, replacement and maintenance of the corner rolls 112 and 114 can be carried out off the line after pulling the unitary frame 116 out by using a crane.

Figure 10:
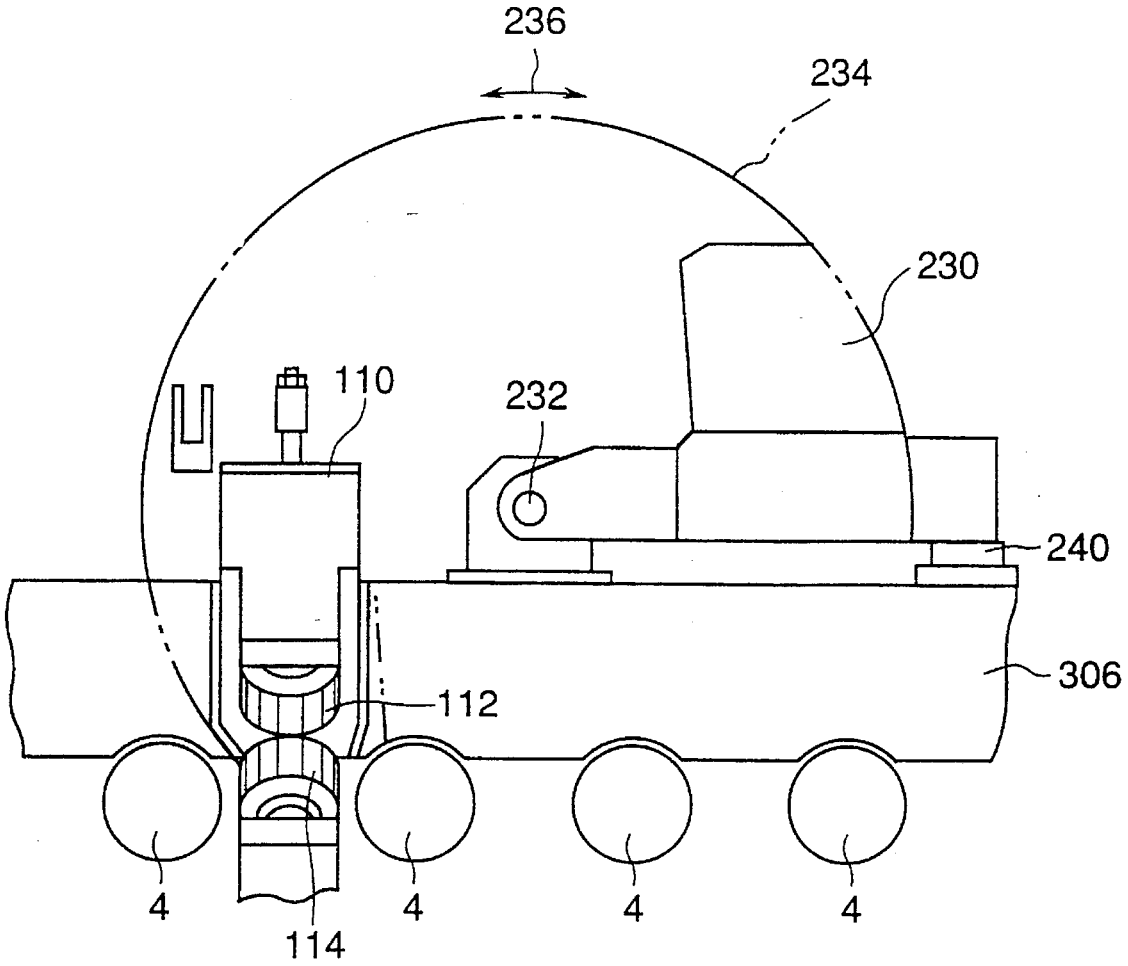
FIG. 10 is a front view of the first embodiment.
Figure 11:
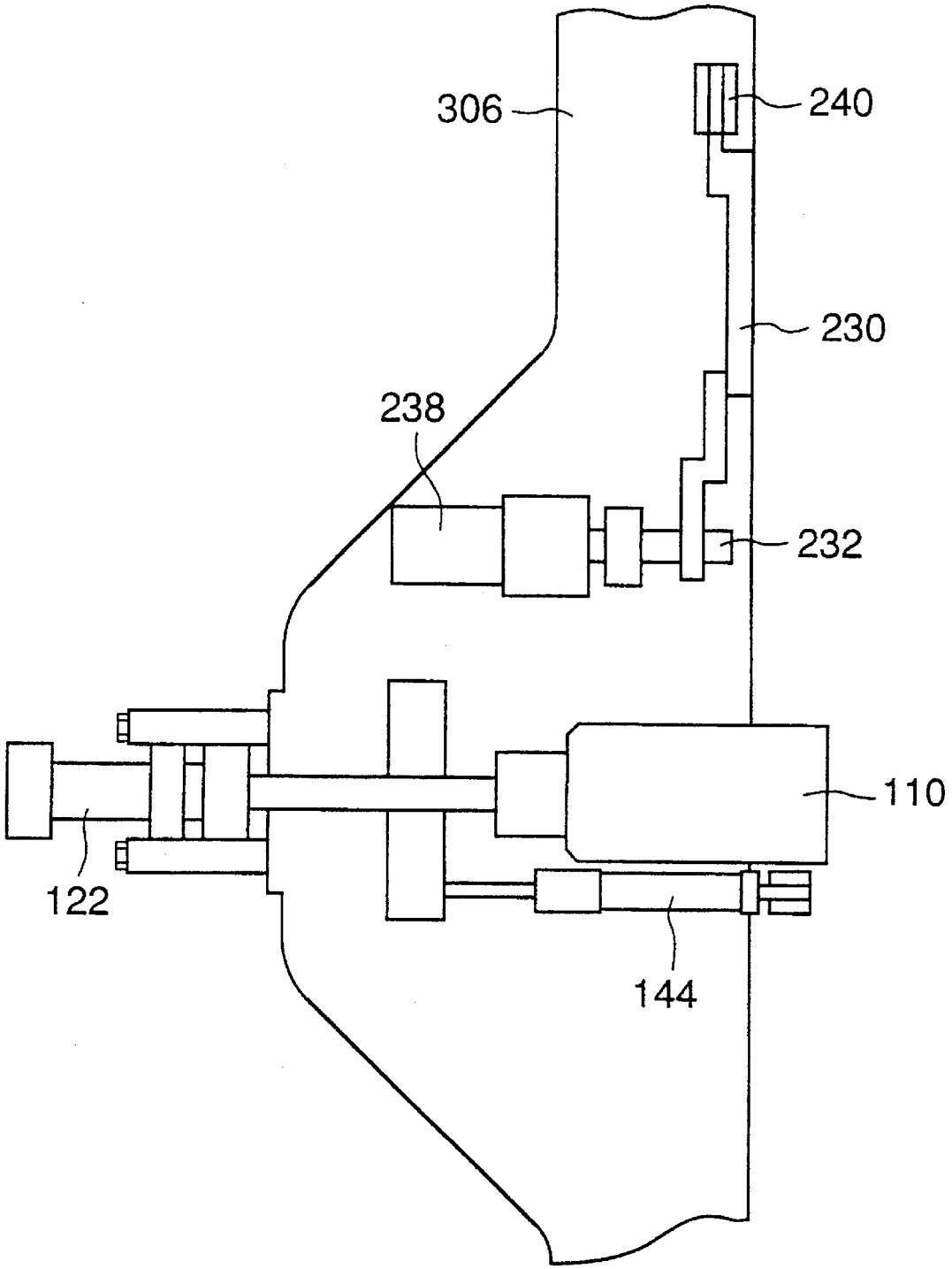
FIG. 11 is a plan view of the first embodiment in corner reduction state.
Figure 12:
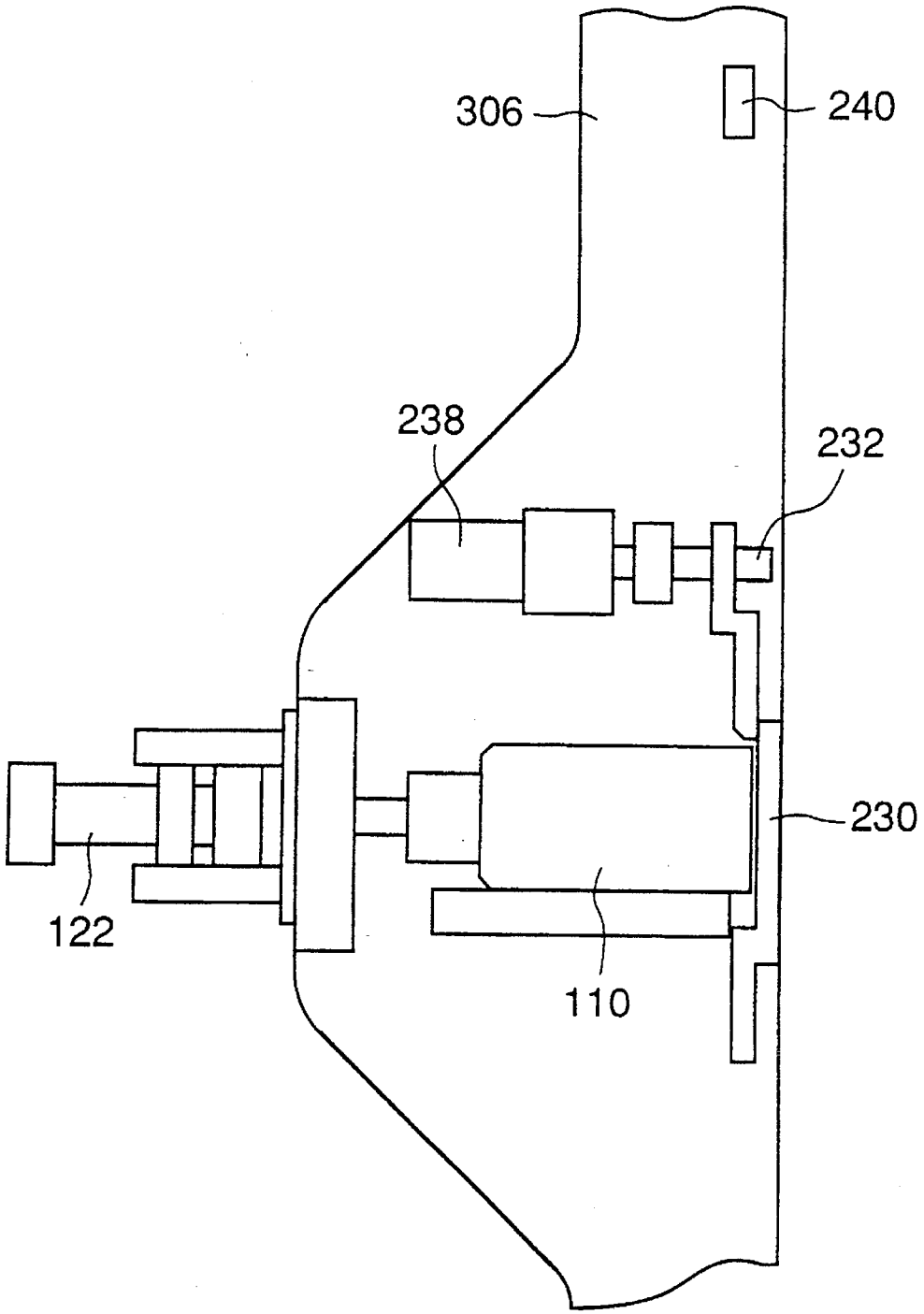
FIG. 12 is a plan view of the first embodiment in waiting state.

When no corner rolling is done by the corner reduction device of the first embodiment, a side guide closing member 230 (for example a door) shown in FIGS. 10, 11 and 12 is moved in a circular form 234 on the center of the shaft 232 by means of a driving device 238 (for example a hydraulic motor) to thereby close the opening section of the side guide 306 as shown by the arrow 236. In FIGS. 10 and 12, a reference numeral 4 denotes a table roll.

When the corner rolls 112 and 114 are to be replaced, the lifting power control cylinder 144 is over-stroked to open the upper cover 140. After the corner rolls are pulled upwardly with the old corner roll mounting frame 116, the unitary frame mounted with new corner rolls is required Just to be suspended and inserted. Then the old corner rolls 112 and 114 are removed from the unitary frame 116 off the line for replacement with new rolls, which can be mounted simply by setting.

Figure 13:
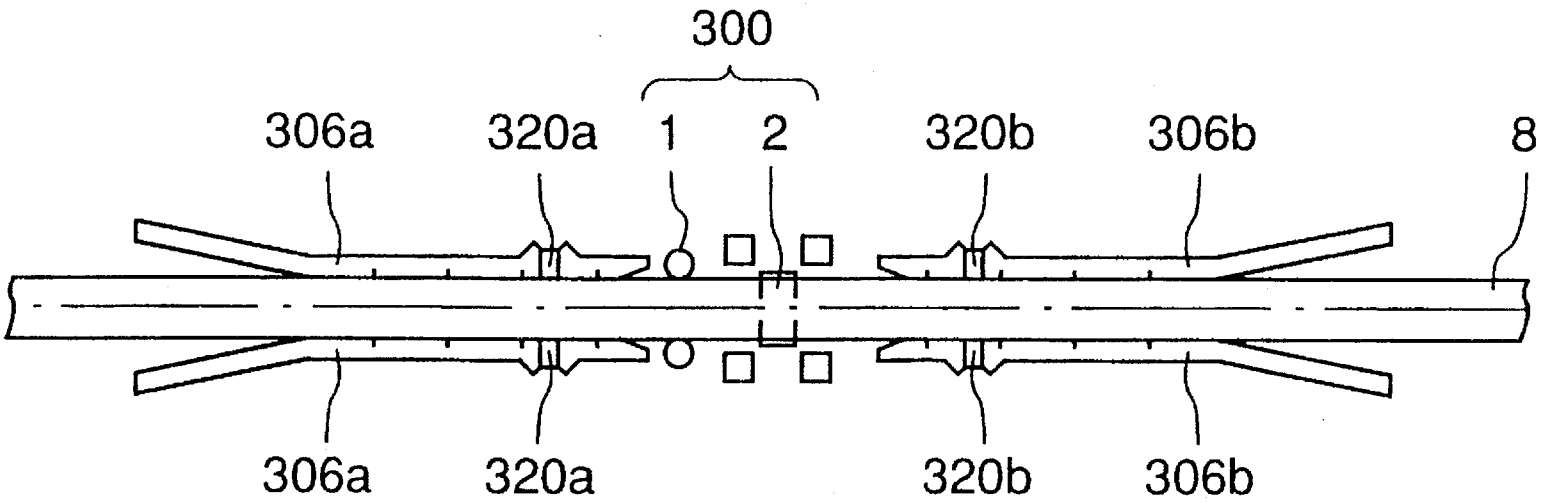
FIG. 13 is a plan view showing the general arrangement of the first embodiment.

Next, a concrete method of using the device of the first embodiment will be explained. As shown in FIG. 13, the corner reduction devices 320*a* and 320*b* of the first embodiment are mounted respectively on the side guides 306*a* and 306*b* on the entrance and exit sides of the reversing mill 300 with an edger 1 disposed on the entrance side of the horizontal mill 2. The corner rolls 112 and 114 for rolling reduction of corners are idle rolls; when the slab 8 is moved back and forth by the driving force of the reversing mill 300, the rolling reduction of the slab 8 is carried out by the corner reduction device 320*a* or 320*b* on the entrance side by utilizing this driving force.

In FIG. 13, when the slab 8 advances to the side guide 306*a* from the left side as viewed towards the view, the side guide 306*a* performs centering and correction of bends of the slab 8 with the corner reduction device 320 on the entrance side held in the retreated state. Because the opening at the location of the corner reduction device 320*a* is closed, the centering and the straightening of bends of the slab 8 by the side guide 306*a* can be done without presenting any problem. In this state, the corner roll unit 110 of the corner reduction devices 320*a* and 320*b* are waiting with the vertical positions thereof determined in accordance with the thickness of a material to be rolled, within the side guide 306*a* or 306*b* on both the entrance and exit sides.

After the leading end of the slab 8 which has been guided by the side guide 306*a* on the entrance side has left the side guide 306*a* and before the instant of biting in the reversing mill 300, the guide bar closing member 230 of the corner reduction device 320*a* is opened. Then, after the leading end of the slab 8 has passed the edge 1 and before the instant of biting in the horizontal mill 2, the reduction cylinder 122 of the corner reduction device 320*a* moves the corner roll unit 110 horizontally to reduce the corner portions of the slab 8.

At this time, the corner roll unit 110 of the corner reduction device 320*b* at the exit side is in the retreat position, and the guide bar closing member 230 remains closed. During rolling of the slab 8 from the reversing mill 300 towards the side guide 306*b*, the slab 8 is restricted and straightened at the exit side by means of the side guide 306*b*.

Thereafter, the corner reduction device 320*b* at the exit side advances towards the reversing mill 300 from the side guide 306*b*. After the tail end of the slab 8 has left the side guide 306*b* and before the slab 8 is gripped by the reversing mill 300, the guide bar closing member 230 is opened. After the instant of biting in the mill, the corner roll unit 110 is moved horizontally to reduce the corners of the slab 8. When there is no fear that the slab will be caught by an opening of the guide bar closing member, the material may be restricted and straightened with the opening left unclosed.

The rolling reduction of corners of the slab 8 is carried out by utilizing a drawing force when drawing the slab 8 by the reversing mill 300 in the process of rolling the slab 8 from the corner reduction device 320*a* or 320*b* towards the reversing mill 300.

A portion not subjected to rolling reduction by the corner reduction device 320*a* at the entrance side is rolled by the corner reduction device 320 at the exit side. The slab 8, therefore, can be rolled for reduction of corners for the overall length thereof.

In this case, when the corner reduction device is placed close to a horizontal or vertical rolling mill, it becomes possible to perform corner rolling reduction of a material by utilizing the driving force of the rolling mill, and accordingly it has become unnecessary to use the corner roll driving device.

In the aforementioned embodiment, corner rolling reduction carried out by utilizing the driving force of the rolling mill has been described. The corner reduction device may be placed at the entrance or exit side of the reversing mill or at a one-way mill if a driving device for driving the corner rolls is added to the corner reduction device.

The second embodiment of the corner reduction device pertaining to the present invention is of such a constitution that, similarly to the rolling equipment shown in FIG. 1, the side guides 6 are disposed oppositely on the right and left sides of the pass line L, at the front and rear of the one-way rolling mill 3. In this constitution, as shown in detail in FIGS. 14 to 18, the right and left corner rolling mechanisms A and B are installed in necessary positions in an intermediate part of the right and left side guides 6.

To describe in detail, recesses 6R are formed in opposite parts of the right and left side guides 6; each of the side guides 6 has an opening 118P in opposite faces across the pass line L; the casing 118 extending vertically and provided at the upper end with a removable upper cover 140 is incorporated vertically through the recess 6R; and a support frame 416 which extends laterally is mounted in the upper position of the front and rear side faces in the direction of the pass line L of the casing 118. Furthermore, a base frame 418 having a guide rail 417 which extends laterally is fixedly mounted in position at the front and rear across the recess 6R on the side guide 6; right and left longitudinal guide rollers 419 mounted on the front and rear surfaces of the support frame 416 are engaged with the guide rail 417; and the casing 118 is suspended from the guide rail 417 of the base frame 418 through the guide roller 419 of the support frame 416.

On the underside of the support frame 416 is provided a lateral guide roller 420, which is held in contact with the front and rear opposite surfaces of the base frame 418; and also provided at the lower end section of the front and rear surfaces of the casing 118 is the lateral guide roller 128, which is held in contact with the side face of the guide beam 422 mounted between the right and left table frames 9. Furthermore, in the intermediate portion of the back surface of the casing 118 the rod end of the reduction cylinder 122, is connected. It which is mounted laterally on the back surface section of the side guide 6 and extends and contracts to rotate the guide rollers 419, 420 and 128, thereby moving the casing 118 laterally back and forth to adjust the reduction amount of the right and left corner rolls 112 and 114 described later. Also in the upper position on the back surface of the casing 118 is installed an arm 424 which is formed in a T-letter shape at the forward end portion, and moved out in a lateral direction. A stopper 425 which can be engaged with the forward end portion of the arm 424 is securely installed on the upper surface section of the side guide 6 so that the movement of the casing 118 in the direction of approach may be restricted.

Furthermore, the unitary frame 116 comprising a guide roll 426 so mounted in the upper and lower end positions on the right and left side surfaces as to contact the inside surface of the casing 118 and the upper and lower corner rolls 112 and 114 mounted in the L-arrangement in the opposite surface sections across the pass line L is vertically movably installed like a core within the casing 118, with the upper and lower corner rolls 112 and 114 being exposed from the right and left into the opening 118P of the casing 118 so as to face each other. Then, on the bottom section inside the casing 118 is mounted the preloaded balance cylinder 130 to provide the upward lifting power to the unitary frame 116. In the meantime, there are mounted brackets 430 protruding laterally on the back surface section of each support frame 426. Between these brackets 430 is rotatably supported the shaft 131 which is longitudinally disposed so that the forward end of the L-shaped arm 142 with its base end fixedly mounted to the intermediate portion of the shaft 131 will be guided upwardly above the casing 118. On the forward end of the arm 142, the push rod 132 is mounted in a locked state through the cover 140 of the casing 118, with the lower end thereof held in contact with the upper surface of the unitary frame 116. Furthermore, the lifting power control cylinder 144 is interposed between the link lever 150 mounted on one end of the shaft 131 and the arm 152 erected on one support frame 416 so that the unitary frame 116 may be moved up and down by the operation of the lifting power control cylinder 144, thereby enabling the adjustment of the vertical position of the corner rolls 112 and 114.

Figure 19:
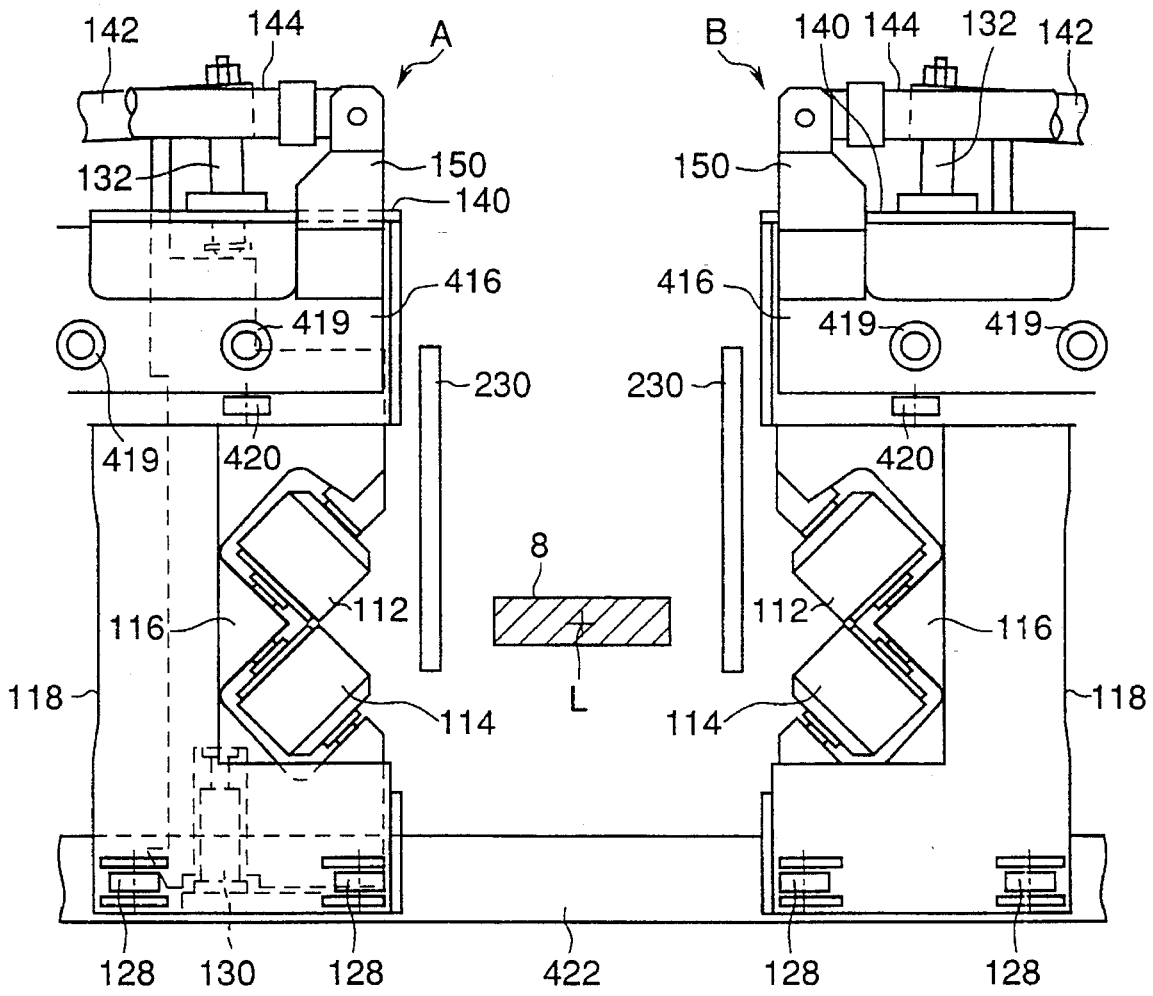
FIG. 19 is a side view showing the second embodiment in waiting state.
Figure 20:
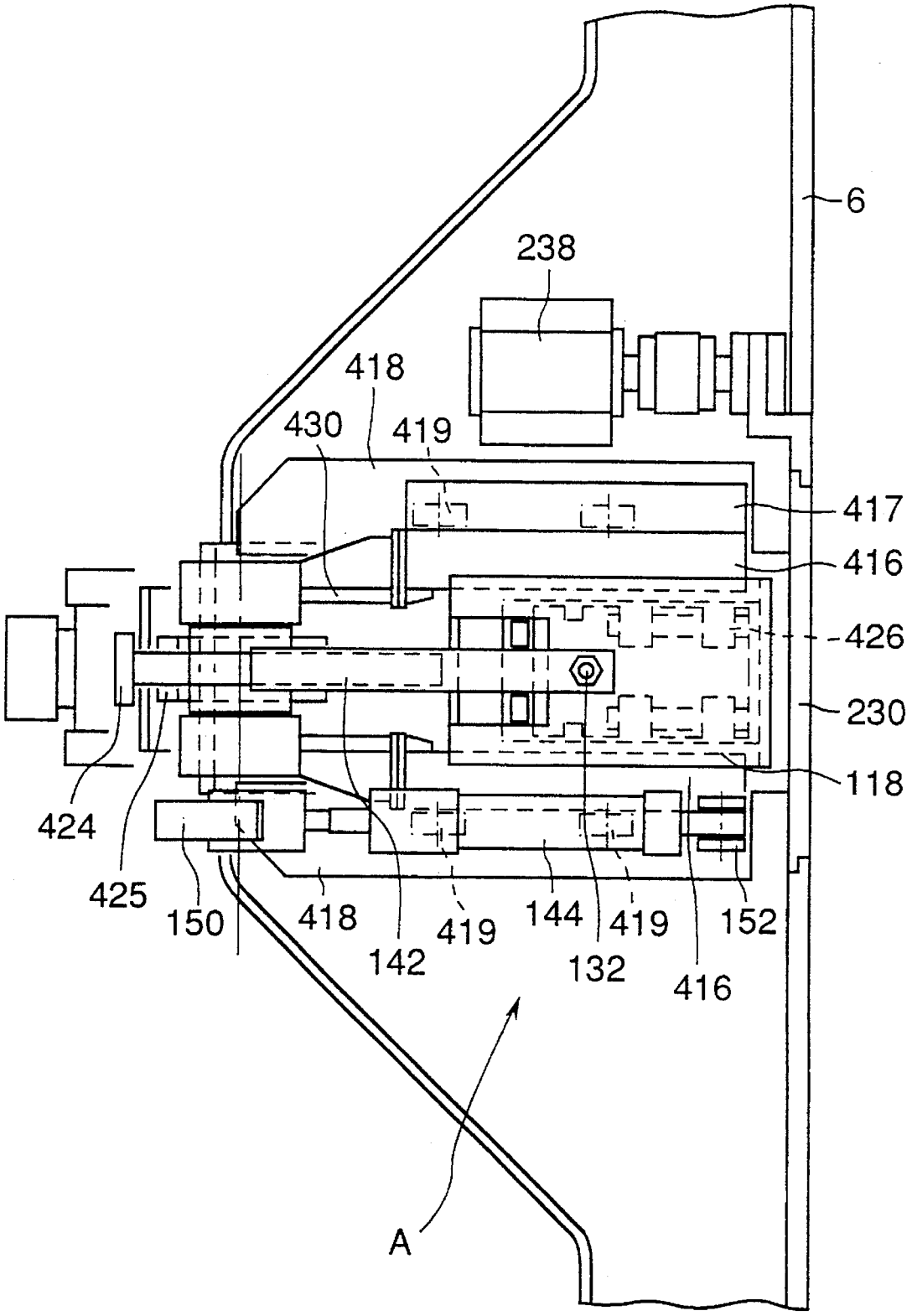
FIG. 20 is a plan view of FIG. 19.

Also as shown in FIGS. 19 and 20, there is provided the door 230 which is designed to swing by a hydraulic motor 238 as far as the position of the recess 6R from above the side guide 6 in order to cover the recess 6R of the side guide 6 when no corner reduction of the slab 8 is carried out.

Figure 3:
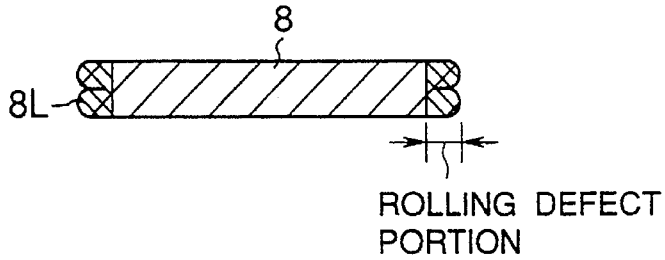
FIG. 3 PRIOR ART
FIG. 3 is a sectional view showing one example of shape of a prior art slab.
Figure 2A:
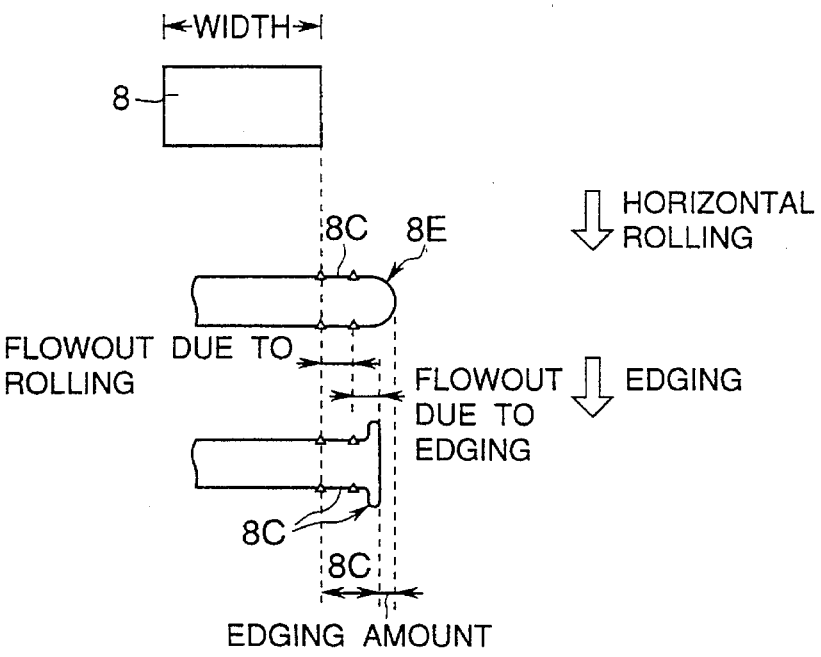
FIG. 2A PRIOR ART
FIGS. 2A and 2B are explanatory views of factors causing the occurrence of detects in end portions of products produced by the prior art rolling equipment.
Figure 2B:
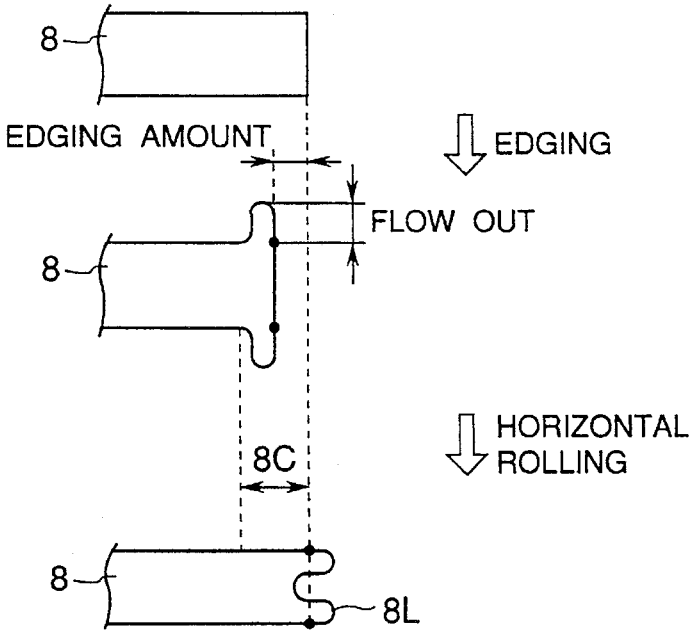
FIG. 2B PRIOR ART
Figure 4A:
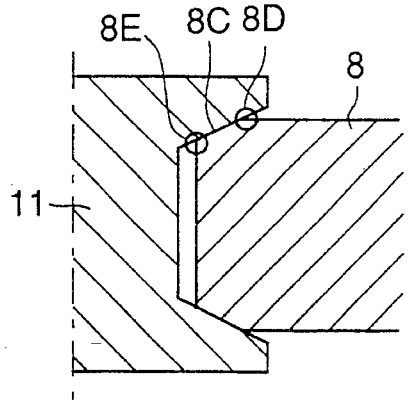
FIG. 4A PRIOR ART
FIGS. 4*a* and 4*b* are explanatory views of prior art disclosed in Japanese Patent Laid-Open No. Sho 53-28542.
Figure 4B:
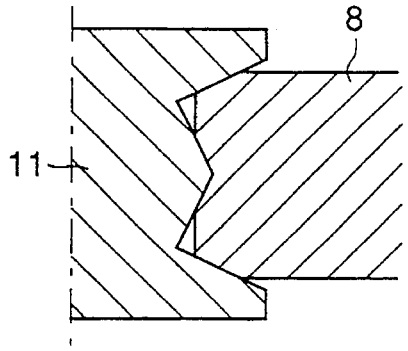
FIG. 4B PRIOR ART
Figure 5:
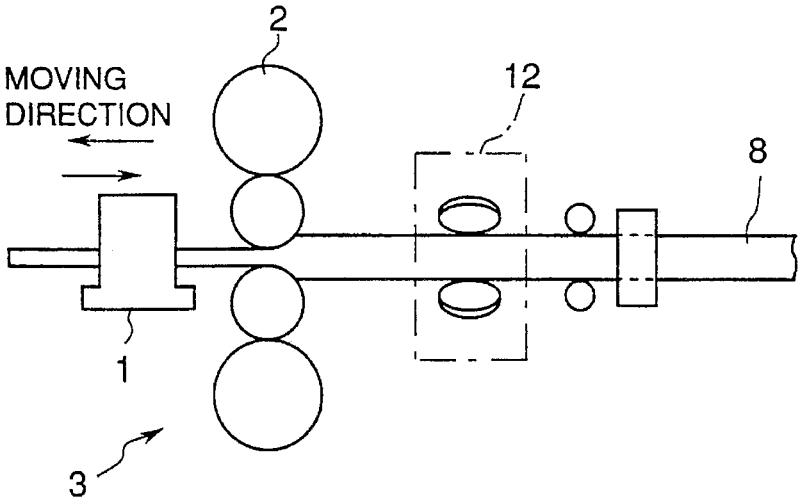
FIG. 5 PRIOR ART
FIG. 5 is an explanatory view of quality improvement of end portions of products by the prior art rolling equipment disclosed in Japanese Patent Laid-Open No. Hei 2-25202.
Figure 6:
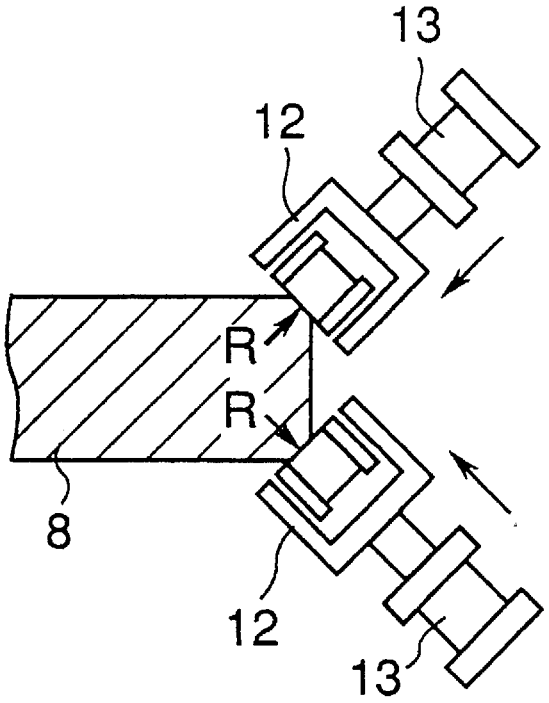
FIG. 6 PRIOR ART
FIG. 6 is an explanatory view of prior art corner rolls disclosed in Japanese Patent Laid-Open Nos. Sho 63-16803, 49-91944, and 63-60003.
Figure 14:
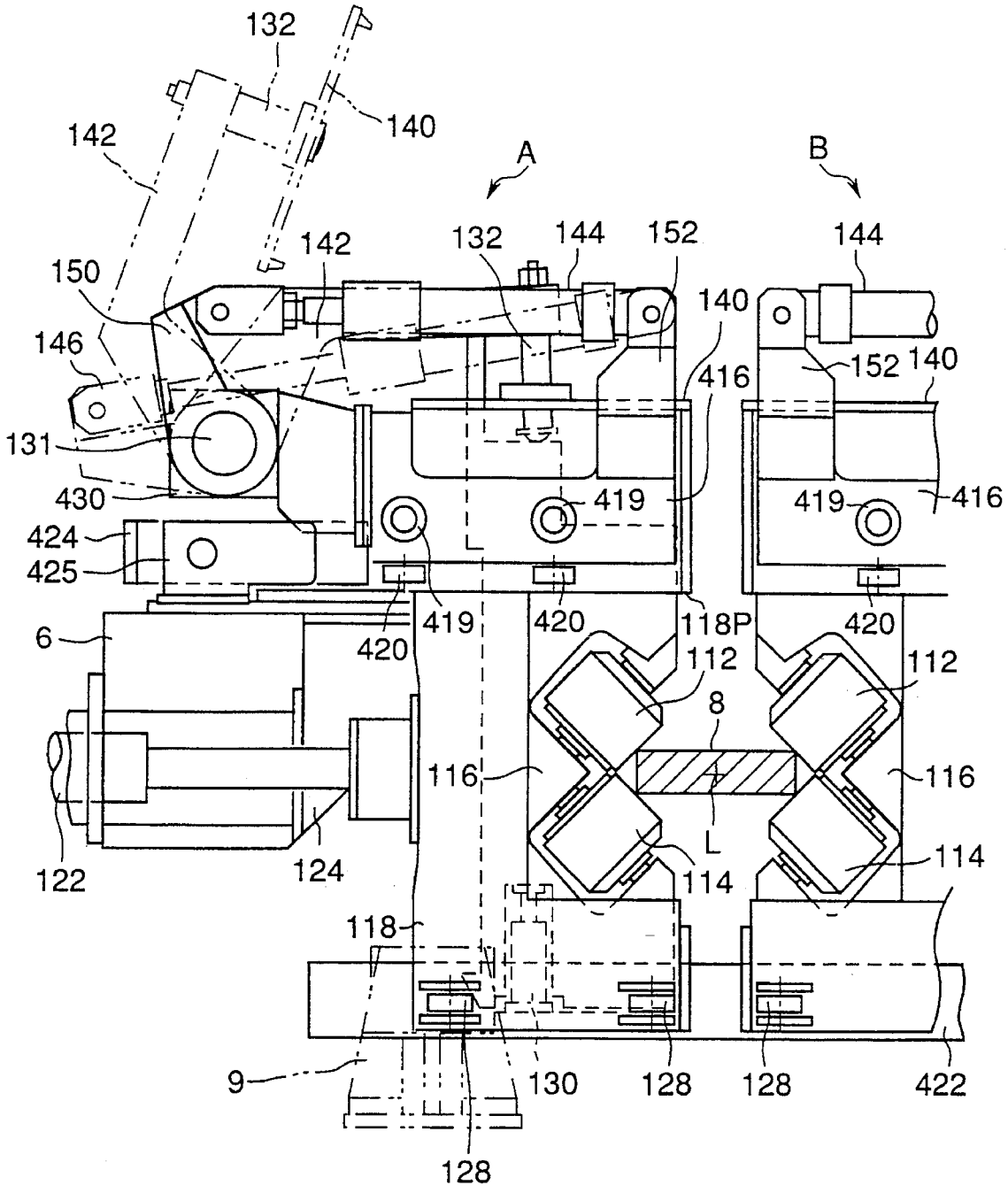
FIG. 14 is a side view of the second embodiment of the corner reduction device according to the present invention.
Figure 15:
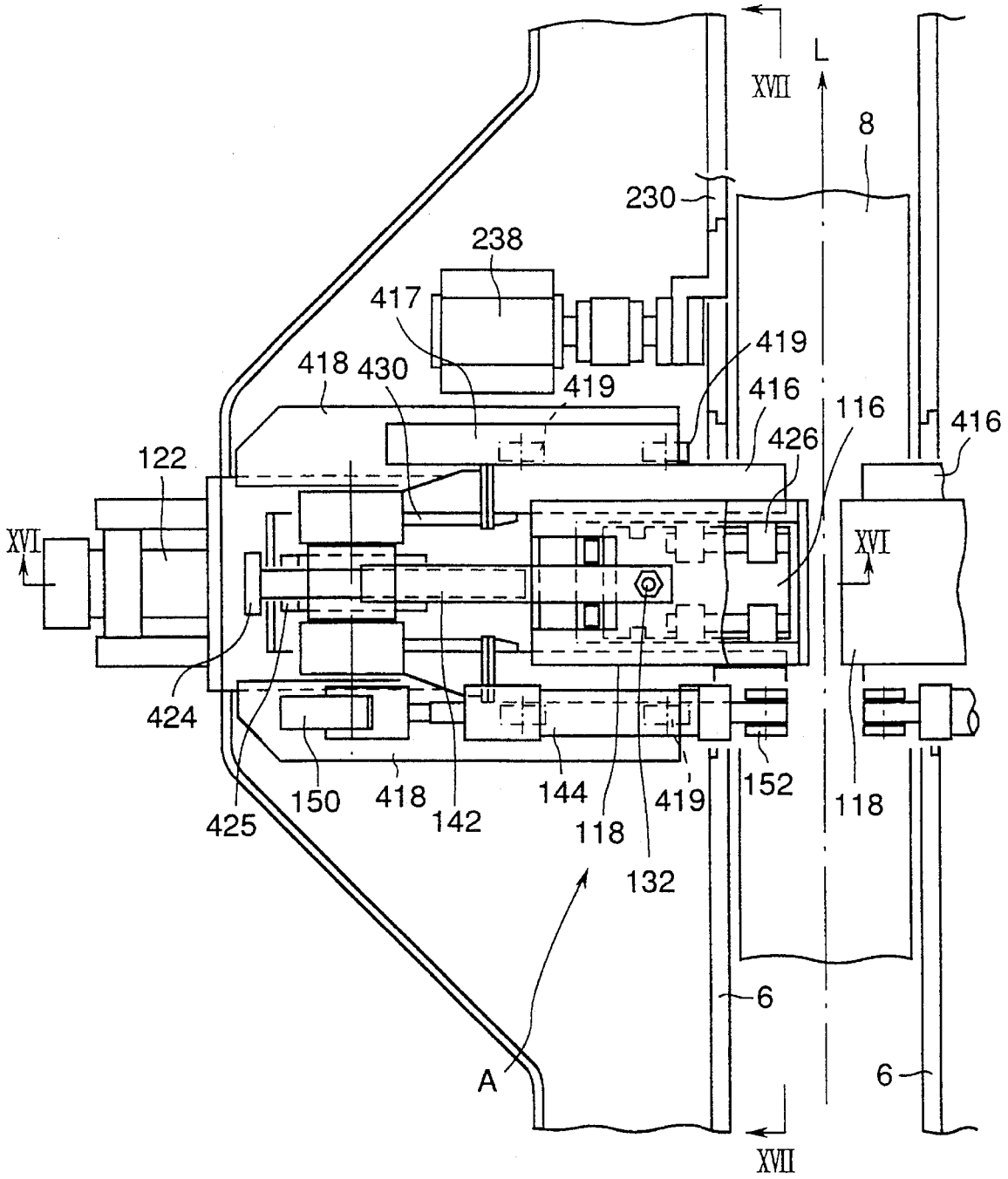
FIG. 15 is a plan view of the second embodiment.
Figure 16:
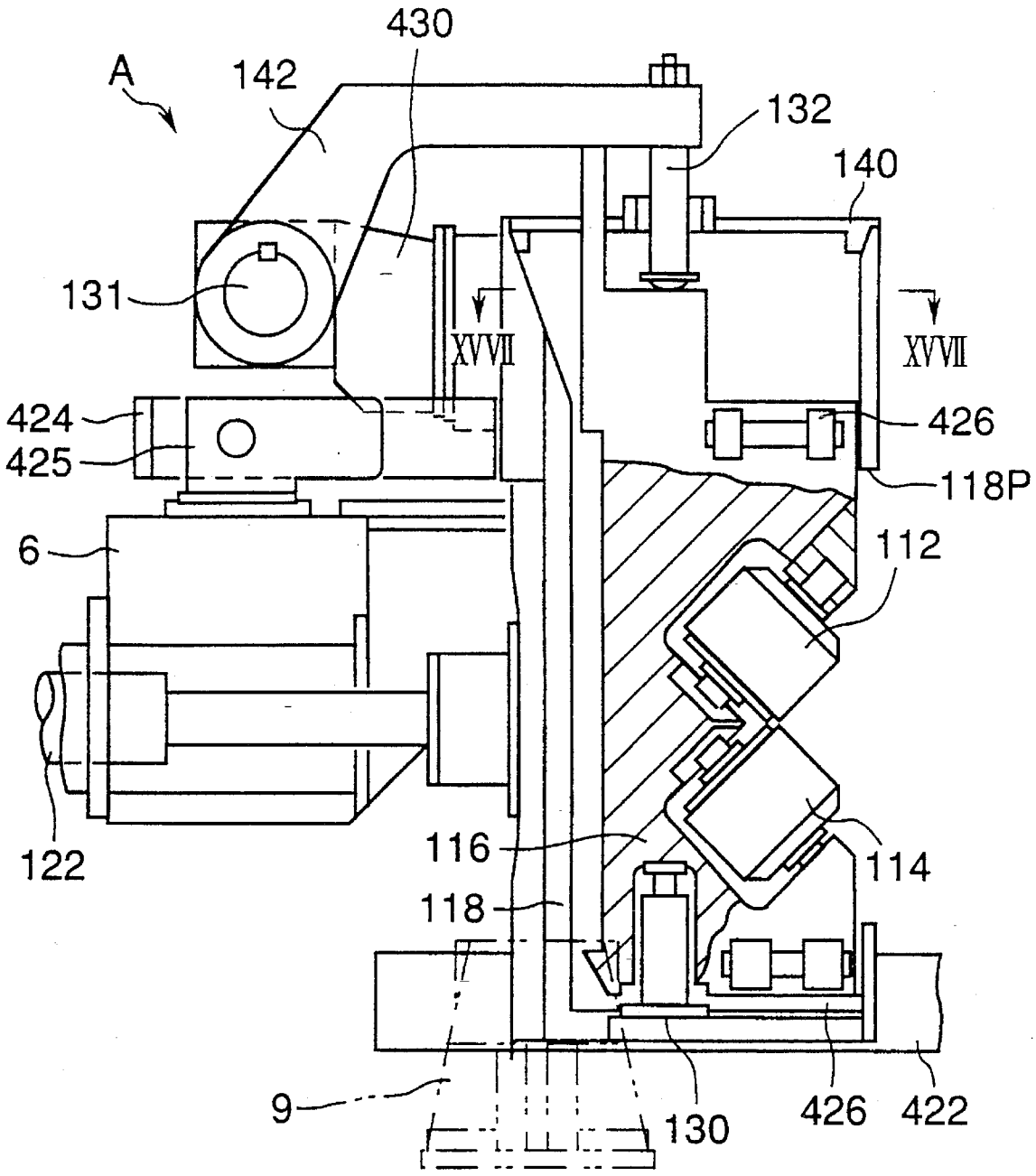
FIG. 16 is a view taken along line XVI–XVI of FIG. 15.
Figure 17:
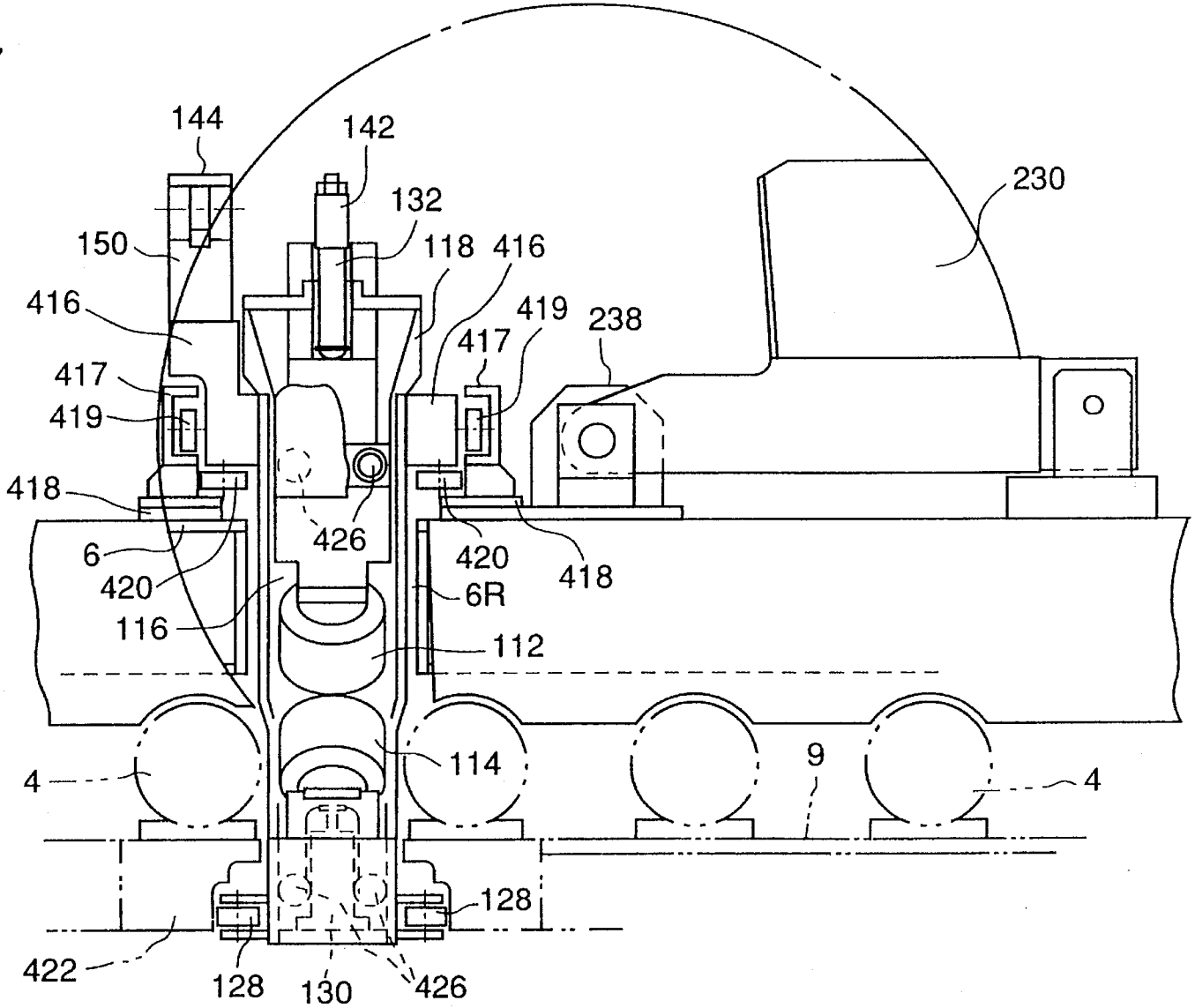
FIG. 17 is a view taken along line XVII–XVII of FIG. 15.
Figure 18:
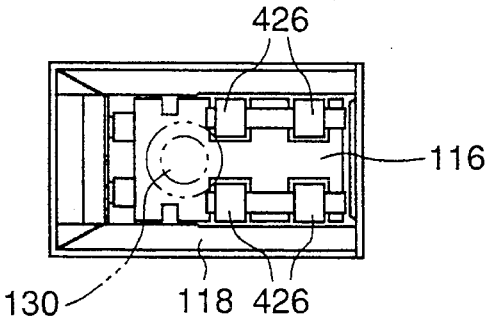
FIG. 18 is a view taken along line XVIII–XVIII of FIG. 16.

According to the corner reduction device of the second embodiment, the upper and lower corners of side edges of the slab 8 are chamfered by rolling with the right and left corner rolls 112 and 114 which are mounted oppositely in the L-type arrangement as shown in FIG. 14 at a stage before entering the rolling equipment 3. Therefore if the slab 8 is repetitively reduced in width and thickness to a thin sheet such as a sheet bar, it is possible to prevent occurrence of flaws in the corners as shown in FIG. 2. Also, in the case of a relatively narrow, thick workpiece, for example a slab for a thick plate, it is possible to prevent the occurrence of an edge overlap 8L in the side edges of the slab 8 as shown in FIG. 3.

Figure 21:
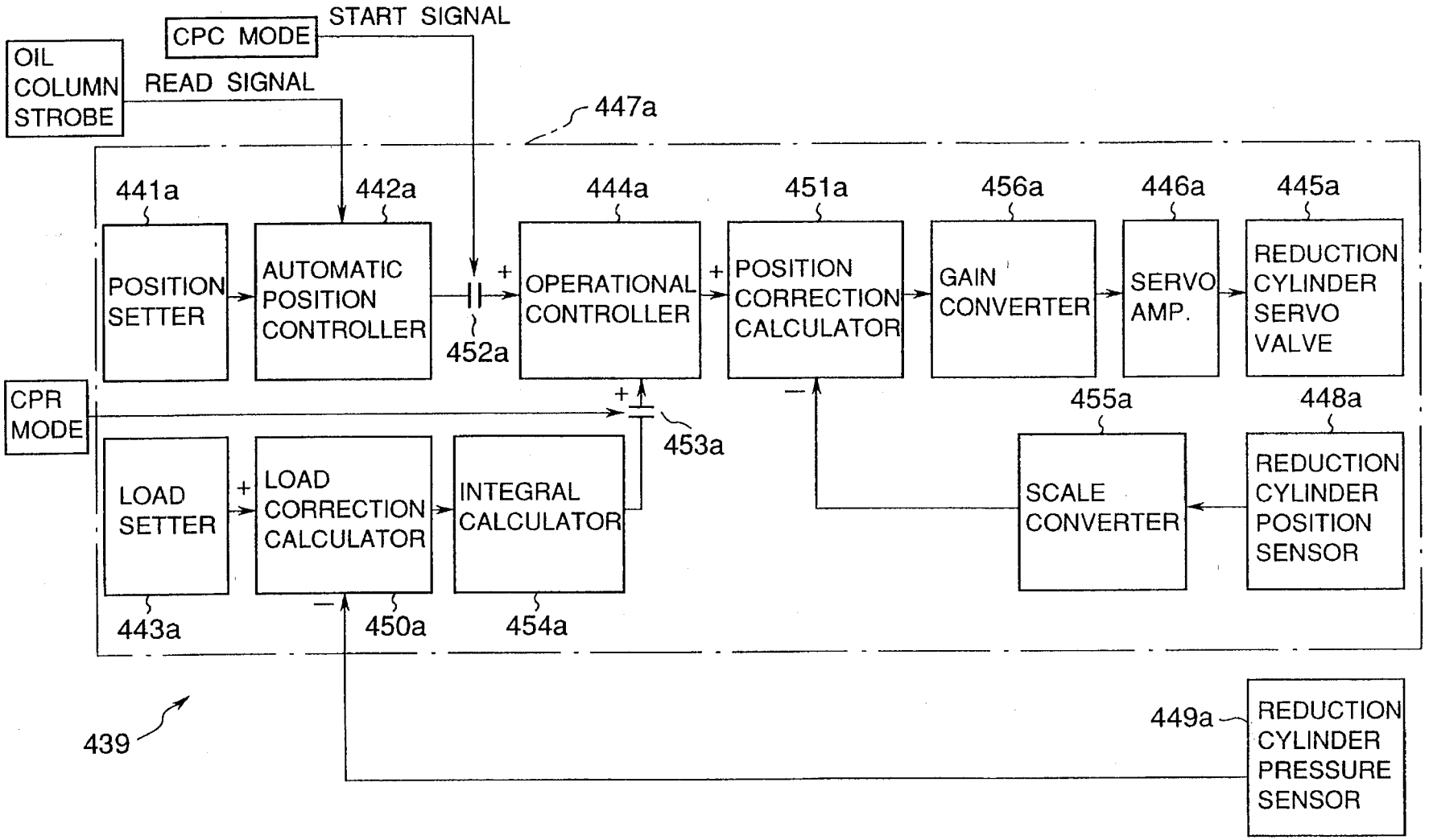
FIG. 21 is a block diagram showing one embodiment of a lateral position control device of the second embodiment.

FIG. 21 shows one embodiment of the control device of the present invention; the corner reduction device of the second embodiment is of such a constitution that a lateral position control device 439 for controlling the position of width direction of the material to be rolled is provided for each of the right and left reduction mechanisms A and B.

Figure 24:
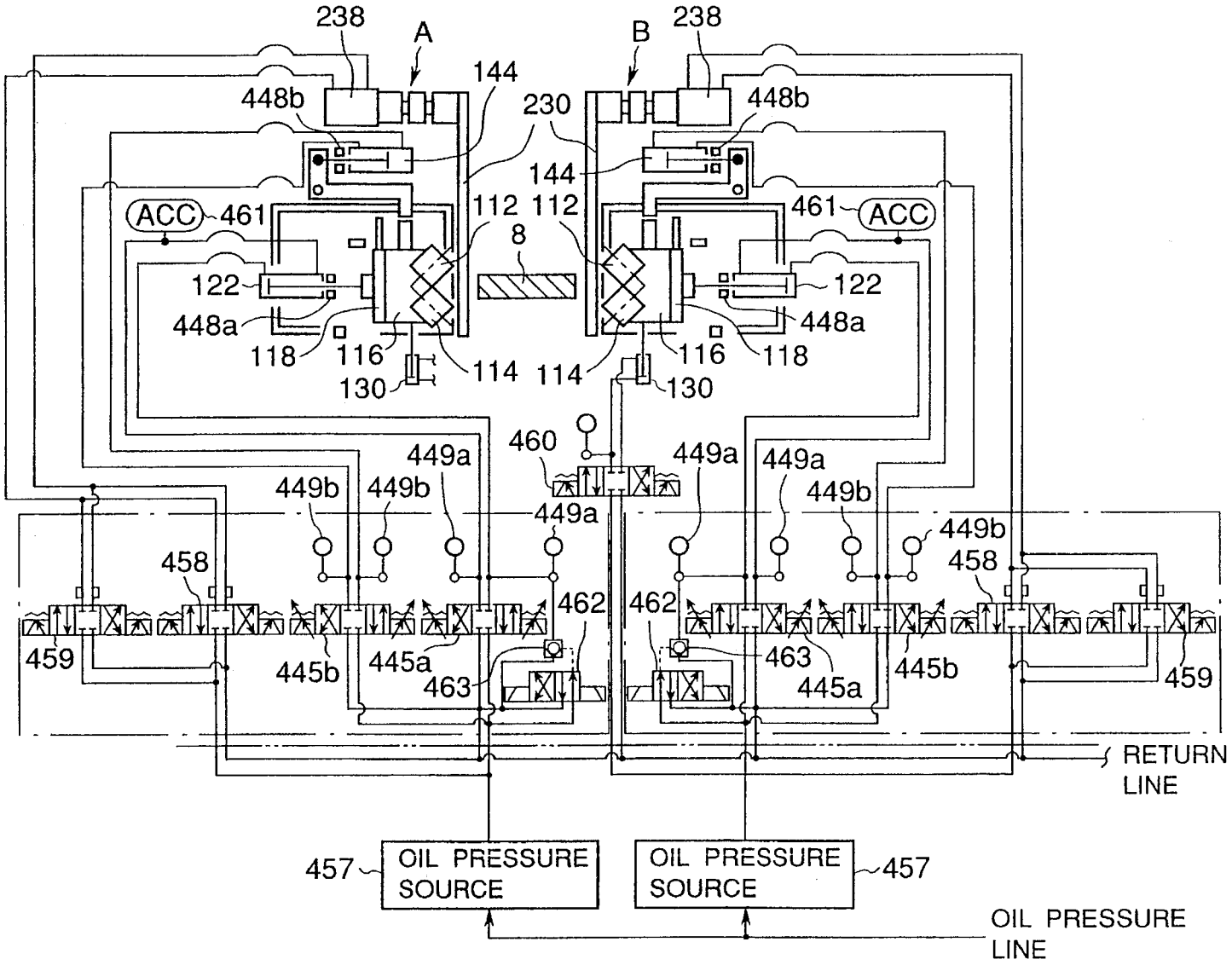
FIG. 24 is an example of a hydraulic system of the corner reduction device according to the present invention.

The lateral position control device 439 for direct control of the reduction cylinder 122 has a position setter 441*a* for setting the position of the reduction cylinder 122 (piston rod position) in accordance with the width of the slab 8 on the entrance side, an automatic position controller 442*a* for outputting a reference command signal for automatically performing Constant Position Control (CPC) on the basis of a position set value which is set by means of the position setter 441 and an oil column strobe read signal which is produced at a data input timing at which a change of an oil column set value is prohibited, a load setter 443*a* for setting a load based on the plate width as a pattern set value, an operational controller 444*a* for calculating a signal from the automatic position controller 442*a* and a signal from the load setter 443*a* to thereby send a drive command to a servo amplifier 446*a* of a reduction cylinder servo valve 445*a* for actuating the reduction cylinder 122, a reduction cylinder position sensor 448*a* shown in FIG. 24 for detection of piston rod position of the reduction cylinder 122, and a position correction calculator 451*a* for correcting a drive command to be inputted into the servo amplifier 446*a* by feeding back the detected value of the position sensor 448*a*, and furthermore is provided with a reduction cylinder pressure sensor 449*a* shown in FIG. 24 which functions to detect a pressure of the reduction cylinder 122, and a load correction calculator 450*a* to thereby correct the load set value to be sent to the operational controller 444*a* after calculation of a deviation of a detected value from the pressure sensor 449*a* and the load set value. A reference numeral 432*a* denotes a position control mode changer which is set by a CPC mode start signal; 453*a* refers to a load control mode changer which is placed on a constant load (pressure) control (Constant Pressure control; CPR) mode start signal; 454*a* is an integral calculator for integrally calculating the output deviation from the calculator 450*a* and changing it to a pulse; 455*a* represents a scale converter for controlling the number of pulses per stroke of the position sensor 448*a* to a scale of the number of pulses per deviation of a set constant; and 456*a* is a gain converter for converting a gain of operation to a gain of servo valve opening.

The position sensor 448*a* is built for example in the reduction cylinder 122 as shown in FIG. 24, serving as a magnetic scale for detecting, with a detecting head secured in a cylinder head, a change in the position of the piston rod whose N and S poles are repetitively magnetized alternately at a micro frequency in a longitudinal direction. It should be noted that the type of the position sensor 448*a* is not limited thereto and the magnetic scale and other types of scales independent of the reduction cylinder 122 are usable.

The servo valve 445*a* is a flapper-type servo valve for example by which a flapper position is controllable with an electric signal. However, types of the servo valve which can be used are not limited to the above type. For example, a needle type servo valve using electro magnetic armature can be used which can arbitrarily control the oil amount of the primary pressure line at the opening of the oil passage between the rod side and head side of the hydraulic cylinder.

Figure 22:
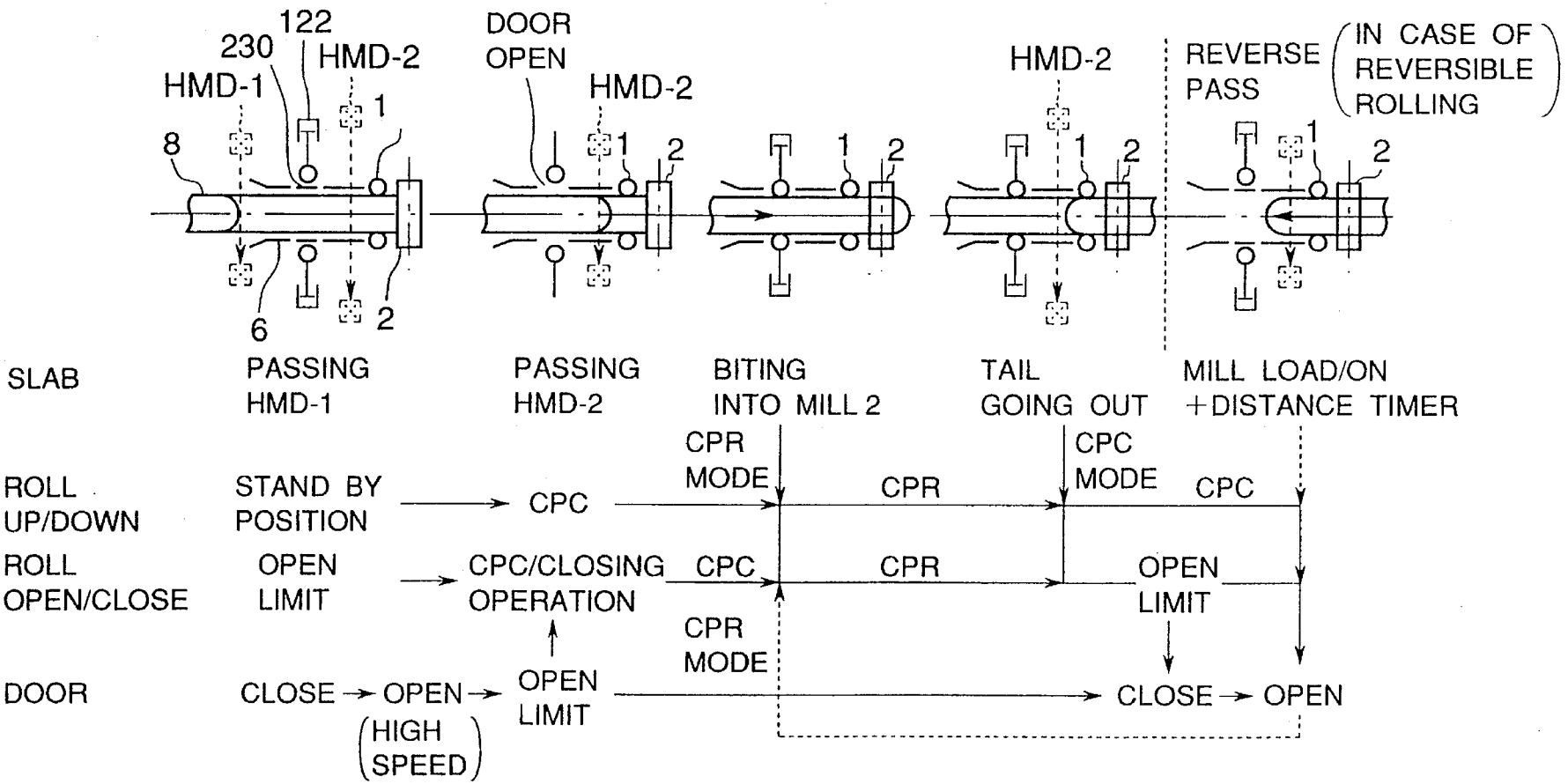
FIG. 22 is an explanatory view showing the operation of the embodiment.

The slab 8, after being rolled, goes to the right and left corner rolls 112 and 114 at a stage before entering the rolling equipment 3 shown in FIG. 1, being chamfered by rolling the upper and lower corners of its side edges as shown in FIG. 14. As shown in FIG. 22, from the waiting condition with the corner rolls in a wide-open position to the reduction position corresponding to the set plate width, the mode changer 452*a* is set to conduct the CPC mode when the top end of the slab 8 is detected by HMD (hot metal detector)-2 disposed at the entrance side of the edger 1 as shown in FIG. 1. When the top end of the slab 8 is bitten by the horizontal mill 2, the mode changer 452*a* is switched off while the mode changer 453*a* is switched on to conduct the CPR mode. Furthermore, when the tail end of the slab has passed the HMD-2, the mode changer 453*a* is set to off while the mode changer 452*a* is set to on to set the operation mode back to the CPC mode.

That is, in the ordinary operation of the lateral position control circuit 447*a*, the servo amplifier 446*a* is driven by a drive command based on the position set value, load set value, and feedback signal from the position sensor 448*a*, thereby controlling the amount of opening and direction of operation of the reduction cylinder servo valve 445*a*.

In the above-described operation, if there exists a deviation in the direction of width, such as the camber, in the slab 8, the pressure sensor 449*a* in the lateral position controller 439 detects the deviation as a change of pressure; a detected value is inputted to the load correction calculator 450*a* for correction of the load set value to be sent into the operation controller 444*a*. Therefore the drive command to be fed to the servo amplifier 446*a* is corrected to adjust the amount of operation of the servo valve 445*a*, thereby enabling proper control of the position of the reduction cylinder 122. That is, the right and left corner rolls 112 and 114 are moved laterally together with the casing 118 and the unitary frame 116 along the camber of the slab 8, thus ensuring uniform rolling reduction amount of right and left corners in the direction of width of the slab 8.

In the present embodiment, the flapper-type servo valve 445*a* employed to change over the flow path can make a quick response.

Figure 23:
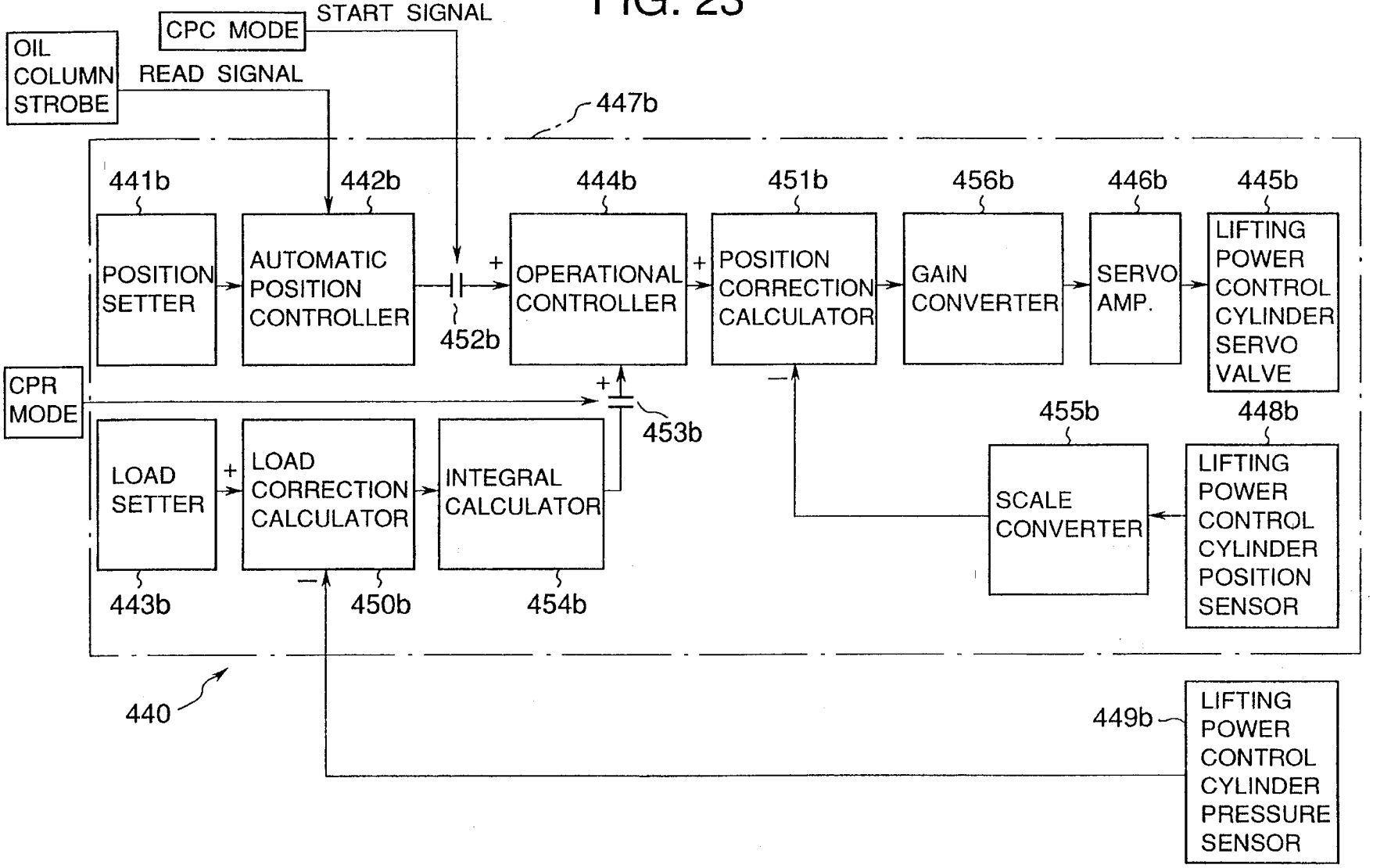
FIG. 23 is a block diagram showing one embodiment of a lifting position control device of the second embodiment.

Next, FIG. 23 shows another embodiment of the control device according to the present invention, in which a lifting position control device 440 is provided by each of the right and left reduction mechanisms A and B to cope with the C-warp of the slab 8. This lifting position control device 440 is provided along with the lateral position control device 439 to cope with the camber of the slab 8.

The vertical position control device 440, which functions to directly control the lifting power control cylinder 144, has a position setter 441*b* for setting the position of the lifting power control cylinder 144 (piston rod position) based on the pass level of the slab 8 as an oil column set value, an automatic position controller 442*b* which outputs a reference command signal for automatically performing constant position control (CPC) on the basis of a position set value set by the position setter 441*b* and the oil column strobe read signal, a load setter 443*b* for automatically setting load based on the pass level to an in-the-board set value, an operational controller 444*b* for calculating a signal from the automatic position controller 442*b* and a signal from the load setter 443*b* and sending a drive command to a servo amplifier 446*b* of a lifting power control cylinder servo valve 445*b* for actuating the lifting power control cylinder 144, a lifting power control cylinder position sensor 448*b* shown in FIG. 24 for the detection of piston rod position of the lifting power control cylinder 144, and a position correction calculator 451*b* for correcting the drive command to be fed to the servo amplifier 446*b* by feeding back the detected value of the position sensor 448*b*, and also is provided with a lifting power control cylinder pressure sensor 449*b* shown in FIG. 24 for detecting the pressure of the lifting power control cylinder 144, and furthermore a load correction calculator 450*b* for calculating a deviation between the detected value of the pressure sensor 449*b* and the load set value and then correcting the load set value to be sent to the operational controller 444*b*. The balance cylinder 130 is so adapted as to perform constant pressure control. The reference numeral 452*b* refers to a position control mode changer which is set to on by a CPC mode start signal; 453*b* is a load control mode changer which is turned on by a load (pressure) control (CPR) mode start signal; 454*b* is an integral calculator for converting a deviation of output of the calculator 450*b* to a pulse after integral calculation control; 455*b* denotes a scale converter for controlling the number of pulses per stroke of output of the position sensor 448*b* to a scale of the number of pulses per deviation of a set constant; and 456*b* refers to a gain converter for converting a gain of calculation to a gain of servo valve opening.

The position sensor 448*b* is built for example in the lifting power control cylinder 144 as shown in FIG. 24, serving as a magnetic scale for detecting, with a detecting head secured in a cylinder head, a change in the position of the piston rod whose N and S poles are repetitively magnetized alternately at a micro frequency in a longitudinal direction. It should be noted that the type of the position sensor 448*b* is not limited thereto and the magnetic scale and other types of scales independent of the lifting power control cylinder 144 are usable.

The servo valve 445*b* is a flapper-type servo valve for example by which a flapper position is controllable with an electric signal. However, types of the servo valve used are not limited to the above type. For example, a needle type servo valve using electro magnetic armature can be used which can arbitrarily control the oil amount of the primary pressure line at the opening of the oil passage between rod side and head side of the hydraulic cylinder.

The corner rolls are controlled to a fixed relation to the slab 8 in a vertical direction by means of the lifting position control circuit 447*b* of the lifting position control device 440 as shown in FIG. 23. To describe this concretely, as shown in FIG. 22, the position of the corner rolls are controlled in the CPR mode from the biting of the leading end to the finish of rolling of the tail end, and in the CPC mode in another range. That is, in the lifting position control circuit 447*b*, the servo amplifier 446*b* is driven by the drive command based on the position set value, load set value, and feedback signal from the position sensor 448*b*, thereby controlling the amount of opening and direction of operation of the lifting power control cylinder servo valve 445*b*.

Waviness, if present in the side edges of the slab 8 in the above-described operation, will be detected as a change in pressure by means of the pressure sensor 449*b* in the lifting direction control device 440; and a detected value will be inputted to the load correction calculator 450*b*, where the load set value to be sent to the operational controller 444*b* will be corrected. Therefore, the drive command to be fed to the servo amplifier 446*b* will be corrected to control the amount of operation of the servo valve 445*b*, consequently properly controlling the position of the lifting power control cylinder 144. That is, the corner rolls 112 and 114 are moved, together with the unitary frame 116, up and down along the waviness of the slab 8, thereby making the vertical rolling reduction amount of the corners of the slab uniform.

In the present embodiment, a flapper-type servo valve 445*b* employed to change over the flow path can make a quick response.

Next, FIG. 24 shows a hydraulic system of the corner reduction device; it should be noted that the same members as those in FIGS. 14 to 23 are designated by the same reference numerals. A reference numeral 457 denotes an oil pressure source including a high/low pressure changeover valve for switching between a high pressure to be used in the CPR mode and a low pressure to be used in the CPC mode; 458 and 459 represent solenoid changeover valves for changing over between pressure oil supply to, and discharge from, the hydraulic motor 238 which opens and closes the door 230; 460 is a solenoid changeover valve for moving the balance cylinder 130 up and down during maintenance work; and 462 expresses a solenoid changeover valve for quick release of the oil pressure line in case of emergency (trouble).

In the above-described embodiment, as shown in FIG. 22, the leading end position and tail end position of the material to be rolled (for example a hot slab) are detected by means of HMD's (hot metal detectors) -1 and -2 shown in FIG. 1 disposed at the entrance and exit sides of the side guide 6, and both the following a and b timings, as shown in FIG. 25, are controlled quickly and exactly, thereby restraining the length of a dummy in the longitudinal direction of the slab. a. Changeover of opening-closing and ascending-descending modes of the corner rolls 112 and 114 (CPC mode to and from CPR mode). b. Opening and closing of the door 230.

Since the position of the slab side edge is subjected to violent changes owing to C warp, camber and waviness during the rolling process, necessary follow-up control is difficult by the CPC mode. Therefore, the CPR mode is used. However high-speed response is required in the CPR mode in performing position control after conversion of a severe behavior of the side edge to a pressure when the corner roll position control is effected. Therefore, conventional solenoid changeover valves, if adopted for the solenoid changeover valves 445*a* and 445*b*, will fail in quick response, and moreover the use of a pressure control. valve with a pilot valve will be required in order to correspond to an optional pressure, resulting not only in a further decreased speed of response but in a non-uniform pressure response accuracy. Consequently, in the present embodiment, the speed of response in the CPR mode has been increased, and the pressure response accuracy has been improved. At the same time, the opening-closing (position) accuracy in the CPC mode has been improved by adopting the flapper-type flow path changeover system and a servo valve capable of operating the flapper position by an electric signal in the oil pressure control system. A digital signal is used for the electric signal, which is little affected by disturbance as compared with an analog signal, enabling high-speed response and high-accuracy control to properly correspond to slab behavior and to operation immediately before and after travel.

Further, an accumulator (ACC) 461 is provided in the rod side oil pressure line of the reduction cylinder 122, a check valve 463 with pilot pressure port is provided in the head side oil pressure line and a switching valve 462 is provided to switch the pilot pressure of the check valve 463 between line pressure and return pressure, so that the corner rolls can be rapidly opened in case of abnormal pressure fall due to going out of the tail end, oil leakage and the like.

It is further understood by those skilled in the art that the foregoing description is a preferred embodiment of the disclosed device and that various changes and modifications may be made in the invention without departing from the spirit and scope thereof.

What is claimed is:

1. A corner reduction device for reducing side corners of a material to be rolled, the corner reduction device comprising:

at least one corner roll unit including a movable unitary frame and a pair of movable upper and lower corner rolls secured to the unitary frame;

a plurality of cylinders each having an associated servo-valve for driving said movable unitary frame in widthwise and vertical directions of said material; and a mechanism for controlling a position of said corner roll unit in the widthwise and vertical directions of said material, wherein an initial position of said corner roll unit is predetermined prior to rolling, said plurality of cylinders comprises at least one right, left, upper and lower cylinder, and each said cylinder and servo-valve are driven in accordance with a difference between pressures of said respective right, left, upper and lower cylinders and a present load value, to follow a shape of said material during the corner rolling.

2. A corner reduction device according to claim 1, wherein said pair of upper and lower corner rolls are non-drive idle rolls.

3. A corner reduction device according to claim 1, wherein said pair of upper and lower corner rolls are drive rolls.

4. A corner reduction device according to claim 1, wherein said corner reduction device is mounted on a side guide at one of an entrance and exit side of a rolling mill, said corner roll unit is withdrawable from a reduction line, and the corner reduction device further comprises a guide beam closing member for closing an opening after withdrawal of said corner roll unit.

5. A corner reduction device according to claim 1, wherein said unitary frame is releasably mounted within a casing.

6. A corner reduction device according to claim 1, wherein said plurality of cylinders define:

a reduction cylinder for moving said unitary frame in the widthwise direction of said material; and said servo-valve operates said reduction cylinder, wherein, prior to corner rolling, said reduction cylinder is driven in accordance to a preset entrance side material width, a load set value of said corner reduction device and a position of said reduction cylinder so said upper and lower corner rolls may be set to fixed positions in the widthwise direction, and during the corner rolling, a pressure of said reduction cylinder is detected to determine the difference between said detected pressure and said load set value to drive said reduction cylinder servo-valve in accordance with said difference.

7. A corner reduction device according to claim 6, wherein said unitary frame is vertically movable in said casing, and said reduction cylinder is adapted to move said unitary frame in a widthwise direction of said material.

8. A corner reduction device according to claim 6, wherein said mechanism for controlling further comprises:

a valve actuator for giving an upward lifting power to said unitary frame;

said plurality of cylinders defining a lifting power control cylinder for controlling said lifting power of said unitary frame; and said servo-valve operates a lifting power control cylinder, wherein, prior to corner rolling, said lifting power control cylinder is driven based on a preset pass level, a load set value of said corner reduction device and a position of said lifting power control cylinder so said upper and lower corner rolls may be set to fixed positions in the vertical direction, and during the corner rolling, a pressure of said lifting power control cylinder is detected to determine a difference between said detected pressure and said load set value to drive said lifting power control cylinder servo-valve in accordance with said difference.

9. A corner reduction device according to claim 8, wherein said unitary frame is vertically movable in said casing, said valve actuator is mounted on an underside of said unitary frame, and said lifting power control cylinder is mounted on an upper surface side of said unitary frame.

10. A corner reduction device according to claim 9, wherein said lifting power control cylinder opens a top cover of said casing for replacement of said upper and lower corner rolls with said unitary frame.

11. A method of controlling a corner reduction device for controlling positions of upper and lower corner rolls mounted with a casing that can be moved by a reduction cylinder in a direction of material width, said upper and lower corner rolls mounted in opposite surface sections of a side guide located in right and left positions in the widthwise direction across a pass line for said material, the corner reduction device comprising a unitary frame having said upper and lower corner rolls mounted in an L-type arrangement and vertically movable in said casing, a balance actuator on an underside of said unitary frame to provide a lifting power to lift said unitary frame, and a lifting power control cylinder, for controlling said lifting power, disposed on an upper surface of said unitary frame, said method comprising:

controlling a servo-valve to drive a reduction cylinder according to a position based on a preset material width on an entrance side and load set values, prior to corner rolling;

feeding a position of said reduction cylinder to control movement of said upper and lower corner rolls to fixed positions in the direction of material width; and detecting said reduction cylinder pressure during corner rolling to determine a difference between said pressure and said preset load set value and to correct the driving of said reduction cylinder servo-valve in accordance with said difference.

12. A method of controlling a corner reduction device according to claim 11, further comprising:

controlling a servo-valve to drive a lifting power control cylinder to a position based on the pass line and load set values prior to corner rolling;

feeding the position of said lifting power control cylinder to control movement of said upper and lower corner rolls to fixed positions in the vertical direction; and detecting a lifting power control cylinder pressure during corner rolling to determine a difference between said pressure and said preset value of load to correct the driving of said lifting power control cylinder servo-valve in accordance with said difference.

13. A control device of a corner reduction device for controlling the corner reduction device, the corner reduction device being mounted with a casing, which can be moved by a reduction cylinder in a widthwise direction of a material, upper and lower corner rolls mounted in opposite surface sections of a side guide located in right and left positions in the widthwise direction across a pass line for said material, the corner reduction device comprising a unitary frame having upper and lower corner rolls mounted in an L-type arrangement and vertically movable inside said casing, a balance actuator on an underside of said unitary frame to provide a lifting power to lift said unitary frame, and lifting power control cylinder, for controlling lifting power, disposed on an upper surface side of said unitary frame, said lifting power control cylinder controlling positions of said upper and lower corner rolls, said control device comprising:

a lateral position control circuit having a position setter for setting a position of said reduction cylinder and a lateral position load setter for setting a lateral load;

an operational controller for sending a drive command to a reduction cylinder and servo-valve for operating said reduction cylinder according to values of said lateral position setter and said lateral load setter;

a reduction cylinder position sensor for detecting a position of said reduction cylinder;

a position correction calculator for correcting said drive command according to a signal fed back from said position sensor;

a reduction cylinder pressure sensor for detecting a pressure of said reduction cylinder; and a load correction calculator for correcting a load set value to be fed to said operational controller by making a comparative calculation of a detected value of said pressure sensor with said load set value.

14. A control device of a corner reduction device according to claim 13, further comprising:

a vertical position control circuit having a vertical position setter for setting a vertical position of said lifting power control cylinder and a vertical load setter for setting a vertical load;

a second operational controller for sending a drive command to a lifting power control cylinder and servo-valve for operating said lifting power control cylinder according to values of said vertical position setter and said vertical load setter;

a lifting power control cylinder position sensor for detecting the position of said lifting power control cylinder;

a lifting power control position correction calculator for correcting said drive command according to a signal fed back from said position sensor;

a lifting power control cylinder pressure sensor for detecting a pressure of said lifting power control cylinder; and a load correction calculator for correcting a load set value to be fed to said operational controller by making comparative calculation of a detected value of said pressure sensor with said load set value.

15. A method of reducing material corners, comprising:

gripping a material in a reversing mill;

starting corner reduction with a corner roll unit of a corner reduction device mounted on a side guide at an entrance side after said material is gripped in said reversing mill;

continuing corner reduction to a tail end of the material;

gripping said material in said reversing mill in a reverse rolling from said exit side;

starting corner reduction by a corner roll unit of said corner reduction device mounted on a side guide at an exit side after said material is gripped in said reversing mill in reverse rolling said material from said exit side; and rolling and reducing said corners of a front portion of said material.

16. A method of reducing material corners, comprising:

starting corner reduction with a corner roll unit secured as a unit to a unitary frame, which is movable in widthwise and vertical directions of a material on a corner reduction device mounted on a side guide, at an entrance side before said material is gripped in a rolling mill; and rolling said material from a leading end to a tail end.

* * * * *

UNITED STATES PATENT AND TRADEMARK OFFICE

CERTIFICATE OF CORRECTION

PATENT NO. : 5,613,390

DATED : March 25, 1997

INVENTOR(S) : Takashi ISHIKAWA; Takao YUNDE; Toshisada TAKECHI; Katsumi OKADA; and Takatoshi AMAKAWA It is certified that error appears in the above-indentified patent and that said Letters Patent is hereby corrected as shown below:

On the title page, item [73] should read:

[73] Assignees: Kawasaki Steel Corporation, Hyogo, Japan and Ishikawajima-Harima Heavy Industries Co., Ltd., Tokyo, Japan Signed and Sealed this Twenty-eighth Day of October, 1997

*Attest:*

*Attesting Officer*

BRUCE LEHMAN

*Commissioner of Patents and Trademarks*